US005555078A

United States Patent [19]

Iwama et al.

[11] Patent Number: 5,555,078

[45] Date of Patent: Sep. 10, 1996

[54] SERIAL PRINTER

[75] Inventors: Ryouichi Iwama; Syuzo Masuda, both of Kawasaki, Japan

[73] Assignee: Fujitsu Limited, Kawasaki, Japan

[21] Appl. No.: 425,920

[22] Filed: Apr. 20, 1995

[30] Foreign Application Priority Data

May 18, 1994 [JP] Japan ..... 6-104086

[51] Int. Cl.[6] ..... G03G 15/00; G03G 15/01; G03G 15/20

[52] U.S. Cl. ..... 355/210; 347/138; 347/152; 355/290; 355/326 R; 400/82

[58] Field of Search ..... 400/82; 347/118, 347/138, 152, 156; 355/326 R, 327, 289, 290, 210, 211

[56] References Cited

U.S. PATENT DOCUMENTS 4,694,305 9/1987 Shiomi et al. ..... 400/82 X

FOREIGN PATENT DOCUMENTS

| | | |
|---|---|---|
| 56-77167 | 6/1981 | Japan . |
| 61-152463 | 7/1986 | Japan . |
| 61-145649 | 9/1986 | Japan . |
| 61-286160 | 12/1986 | Japan . |
| 62-58277 | 3/1987 | Japan . |
| 1-208139 | 8/1989 | Japan . |

*Primary Examiner*—Joan H. Pendegrass
*Assistant Examiner*—Sophia S. Chen
*Attorney, Agent, or Firm*—Armstrong, Westerman, Hattori, McLeland & Naughton

[57] ABSTRACT

A serial printer has a plurality of printing assemblies each comprising, a transport mechanism for transporting a recording sheet in a sheet transport direction, a process part, including an image bearing member with a rotary shaft which extends in a direction parallel to the sheet transport direction, for forming a latent image on the image bearing member by charging the image bearing member and developing the latent image into a developed image, a fixing unit, including a first fixing member, for fixing the developed image on the image bearing member onto the recording sheet by the first fixing member, at least one printing carriage movable in a carriage moving direction perpendicular to the sheet transport direction and supporting the process part and the fixing unit, and a transfer unit for transferring the developed image formed on the image bearing member onto the recording sheet that is interposed between the transfer unit and the printing carriage. The image bearing member rotates in synchronism with a moving speed of the printing carriage. A moving mechanism moves the printing carriage in the carriage moving direction. The printing assemblies are arranged at predetermined intervals in the sheet transport direction. A controller controls the transport mechanism so that the recording sheet is transported by predetermined amounts in the sheet transport direction.

11 Claims, 29 Drawing Sheets

51E

SERIAL PRINTER

BACKGROUND OF THE INVENTION

The present invention generally relates to serial printers, and more particularly to a serial printer which prints an image on a recording sheet using the electrophotography technique by forming a toner image on the recording sheet by a recording drum.

Recently, in order to meet the demands to reduce both the cost and size of printers using the electrophotography technique, serial printers provided with a carriage that carries out the printing using the electrophotography technique have been developed. According to such a serial printer, the carriage is moved on a transfer unit in a direction perpendicular to a sheet transport direction of the recording sheet so as to transfer an image on the recording sheet, and the transferred image on the recording sheet is fixed by a fixing unit which has the form of a roller arranged in the sheet transport direction. There are now demands to improve the printing quality of such serial printers, and to also realize high-speed printing and color printing.

FIGS. 1A and 1B show the construction of a first conventional serial printer. FIG. 1A shows a plan view of a part of this first conventional serial printer, and FIG. 1B shows a cross section of a carriage of this first conventional serial printer.

A serial printer 11 shown in FIGS. 1A and 1B is proposed in a Japanese Laid-Open Patent Application No.61-152463, for example. A shaft 14 is arranged parallel to transport rollers 13*a* and 13*b* which transport a recording sheet 12 in a sheet transport direction. A carriage 15 is movable in a direction perpendicular to the sheet transport direction under guidance of the shaft 14, and this carriage 15 is driven by a driving motor (not shown). A fixing unit 16 having a width greater than the width of the recording sheet 12 is fixedly arranged on the downstream side of transport roller 13*a* in the sheet transport direction. A transfer unit 17 is arranged under the recording sheet 12 along a moving direction of the carriage 15.

An image bearing member 21 is provided in the carriage 15, and this image bearing member 21 rotates at a peripheral speed in synchronism with the movement of the carriage 15. The surface of the image bearing member 21 is uniformly charged by a charger 22, and an electrostatic latent image is formed on the surface of the image bearing member 21 by an exposing unit 23. The electrostatic latent image on the surface of the image bearing member 21 is visualized into a toner image by a developing roller 26 using a toner 25 of a developing unit 24. The toner image on the image bearing member 21 is transferred onto the recording sheet 12 by the transfer unit 17 which confronts the image bearing member 21 via the recording sheet 12, and the transferred image is fixed when it is transported to the position of the fixing unit 16.

FIG. 2 shows the construction of a carriage provided with a fixing unit. This carriage is proposed in a Japanese Laid-Open Utility Model Application No.61-145649, for example. A fixing unit 27 is provided inside a carriage 15. A cleaner 30 cleans the surface of the image bearing member 21 after the printing ends so as to remove the residual toner.

A fixing roller 28 which rotates in the same direction as the image bearing member 21 is provided in the fixing unit 27. A heat source 29 such as a halogen lamp is provided within the fixing roller 28 as a heating means. This fixing roller 28 is preheated to a predetermined temperature by the heat source 29 prior to the printing operation, and the temperature during the printing is controlled by detecting the temperature by a temperature detector (not shown) such as a thermistor. In other words, the fixing unit 27 is moved together with the image bearing member 21 and carries out the image fixing immediately after the image transfer.

The image transfer by the transfer unit 17 is carried out by applying a predetermined voltage across the transfer unit 17 and the image bearing member 21. Hence, a conductive member such as conductive rubber is formed on a substrate which is made of aluminum or the like, to form the transfer unit 17.

Although not shown, a fixing unit is provided within the carriage, and this fixing unit is provided with a non-contact type heat source that irradiates a heat ray on the recording sheet. The non-contact type heat source may be a halogen lamp using infrared ray or, a xenon lamp using flash fixing. According to the serial printer proposed in a Japanese Laid-Open Patent Application No.56-77167, for example, the image bearing member (recording drum) recedes from the recording sheet about a guide shaft of the carriage when transporting the recording sheet.

Next, a description will be given of a second conventional serial printer, by referring to FIG. 3. FIG. 3 shows a line type color printer 31.

In FIG. 3, a charger 33, an exposing unit 34, three developing units $\mathbf{35}_Y$, $\mathbf{35}_M$ and $\mathbf{35}_C$, and a transfer drum 37 are arranged around a photosensitive drum 32. A recording sheet is wrapped around the transfer drum 36 and is clamped thereon. The developing unit $\mathbf{35}_Y$ is filled with yellow toner, the developing unit $\mathbf{35}_M$ is filled with magenta toner, and the developing unit $\mathbf{35}_C$ is filled with cyan toner.

In other words, the photosensitive drum 32 is uniformly charged by the charger 33, and a cyan portion is exposed by the exposing unit 34 and a cyan toner image is formed on the photosensitive drum 32 by the developing unit $\mathbf{35}_C$. This cyan toner image is transferred onto tile recording sheet on the transfer drum 37 by the transfer unit 36. A magenta toner image is developed by the developing unit $\mathbf{35}_M$ during the next rotation of the photosensitive drum 32, and a yellow toner image is developed by the developing unit $\mathbf{35}_Y$ during the second next rotation of the photosensitive drum 32. As a result, by the sequential transfer of the cyan, magenta and yellow toner images onto the recording sheet, a color image is printed on the recording sheet. The color image transferred onto the recording sheet is heated and fixed by a fixing unit (not shown).

Next, a description will be given of a third conventional serial printer, by referring to FIGS. 4A and 4B. FIG. 4A shows a plan view of a serial color printer 41, and FIG. 4B shows a cross section of the serial color printer 41. This serial color printer 41 is proposed in a Japanese Laid-Open Patent Application No.62-58277, for example.

In a carriage 42, chargers 44*a* and 44*b* and an exposing unit 45 are arranged around a photosensitive drum 43 which rotates in a direction perpendicular to the sheet transport direction of the recording sheet. In addition, developing units $\mathbf{46}_C$, $\mathbf{46}_M$ and $\mathbf{46}_Y$ for the three colors which are cyan, magenta and yellow are arranged in parallel to each other in an axial direction of the photosensitive drum 43 so as not to interfere with each other.

In other words, the surface of the photosensitive drum 43 is divided into equal portions along the axial direction, and the developing units $\mathbf{46}_C$, $\mathbf{46}_M$ and $\mathbf{46}_Y$ are arranged in the axial direction of the photosensitive drum 43 along the moving direction of the carriage 42. Hence, a plurality of color developing units are provided with respect to the surface of the photosensitive drum 43, and each color image can be formed on the recording sheet as the carriage 42 moves back and forth. The color image is formed by feeding the recording sheet by an amount corresponding to the width of the developing unit.

However, according to the first conventional serial printer shown in FIGS. 1A and 1B, the recording sheet 12 is fed intermittently, and there was a problem in that the printing speed is low particularly when the printing is made on a large recording sheet. In addition, the line type fixing unit 16 is provided independently outside the carriage 15. Because the length of the fixing roller amounts to the width of the recording sheet 12 even though the recording sheet 12 is transported intermittently, the contact time between the fixing roller and the recording sheet 12 having the toner image transferred thereon becomes greatly different between the part where the recording sheet 12 is stationary and the part where the recording sheet 12 is transported. This difference in the contact time introduces inconsistent fixing, and there was a problem in that the image quality of the printed image on the recording sheet 12 becomes poor. Generally, the fixing unit 16 fixes the toner image by a fixing roller which is heated to a temperature of approximately 180° C., and there was also a problem in that discoloring of the recording sheet 12 occurs due to the heat and the recording sheet 12 becomes yellowish when the contact between the fixing roller and the recording sheet 12 is maintained for a relatively long time.

On the other hand, according to the carriage shown in FIG. 2, the fixing roller 28 is simply pushed against the conductive rubber of the transfer unit 17. For this reason, the fixing roller 28 cannot push against the transfer unit 17 with a large pressure in order to prevent marks or wrinkles from being formed on the recording sheet 12 by the pressure. As a result, it is necessary to improve the fixing strength by reducing the moving speed of the carriage 15 and increasing the heating temperature so as to increase the effective heating time. However, when the heating temperature and the heating time are set to levels such that the sufficiently large fixing strength is obtained, there were problems in that the moisture absorbency of the recording sheet 12 changes and the recording sheet 12 shrinks, thereby deteriorating the image quality.

According to the color printer 31 shown in FIG. 3, it is necessary to-carry out the process three or more times in order to print a color image. However, there were problems in that it is difficult to accurately position the recording sheet when it is clamped on the transfer drum 37 and it is difficult to detect the position of the recording sheet during the printing process. In addition, there was a problem in that the toner is easily scattered when the recording sheet having the toner image is turned a plurality of times during the printing process. Furthermore, it is necessary to provide three or more developing units having a width greater than or equal to the line width, and there was also a problem in that the size of the color printer 31 increases as the size of the recording sheet is increased.

On the other hand, according to the color printer 41 shown in FIGS. 4A and 4B, the plurality of developing units $\mathbf{46}_C$, $\mathbf{46}_M$ and $\mathbf{46}_Y$ must be mounted with respect to the photosensitive drum 43 within the single carriage 42. In addition, since the printing is carried out as the carriage 42 moves back and forth, the photosensitive drum 43 is rotated in two directions. Hence, there were problems in that the photosensitive drum 43 is easily contaminated by the non-operating developing units, and the image quality is poor. In this case, it is possible to make the non-operating developing units recede from the photosensitive drum 43, similarly to a large color copying machine. However, it is difficult to provide a mechanism for making the plurality of developing units recede from the photosensitive drum 43 within the small carriage 42 that is used in the serial color printer 41.

SUMMARY OF THE INVENTION

Accordingly, it is a general object of the present invention to provide a novel and useful serial printer in which the problems described above are eliminated.

Another and more specific object of the present invention is to provide a serial printer comprising a plurality of printing assemblies each comprising, transport means for transporting a recording sheet in a sheet transport direction, process means, including an image bearing member with a rotary shaft which extends in a direction parallel to the sheet transport direction, for forming a latent image on the image bearing member by charging the image bearing member and developing the latent image into a developed image, fixing means, including a first fixing member, for fixing the developed image on the image bearing member onto the recording sheet by the first fixing member, at least one printing carriage movable in a carriage moving direction perpendicular to the sheet transport direction and supporting the process means and the fixing means, transfer means for transferring the developed image formed on the image bearing member onto the recording sheet that is interposed between the transfer means and the printing carriage, the image bearing member rotating in synchronism with a moving speed of the printing carriage, and first moving means for moving the printing carriage in the carriage moving direction, the printing assemblies being arranged at predetermined intervals in the sheet transport direction, and control means for controlling the transport means so that the recording sheet is transported by predetermined amounts in the sheet transport direction. According to the serial printer of the present invention, it is possible to realize an inexpensive printer that can print at a high speed.

Still another object of the present invention is to provide a serial printer comprising transport means for transporting a recording sheet in a sheet transport direction, a plurality of process means, a printing carriage movable in a carriage moving direction perpendicular to the sheet transport direction and supporting the plurality of process means, and moving means for moving the printing carriage in the carriage moving direction, each of the plurality of process means including an image bearing member with a rotary shaft which extends in a direction parallel to the sheet transport direction and a developing means, for forming a latent image on the image bearing member by charging the image bearing member and developing the latent image into a developed image by the developing means, the developing means of the plurality of process means being provided with developing agents of mutually different colors in the sheet transport direction. According to the serial printer of the present invention, it is possible to prevent an error in the printing position and thus improve the printing quality.

Other objects and further features of the present invention will be apparent from the following detailed description when read in conjunction with the accompanying drawings.

DESCRIPTION OF THE PREFERRED EMBODIMENTS

Figure 1A:
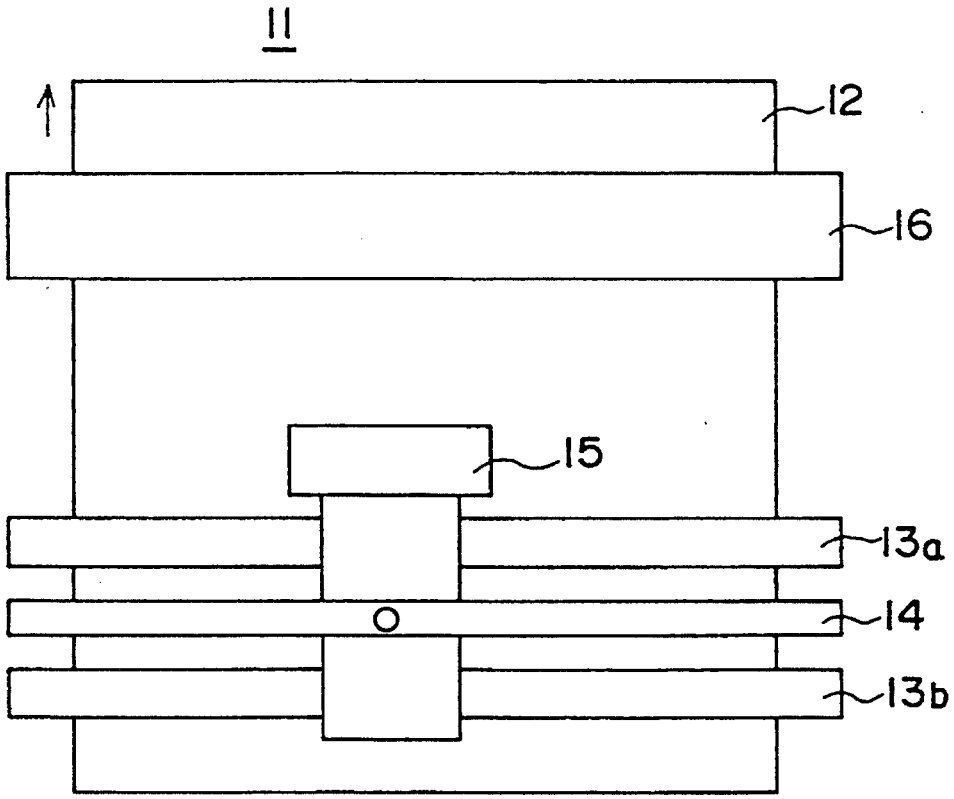
FIG. 1A PRIOR ART
FIGS. 1A and 1B respectively are a plan view and a cross sectional view showing a part of a first conventional serial printer.
Figure 1B:
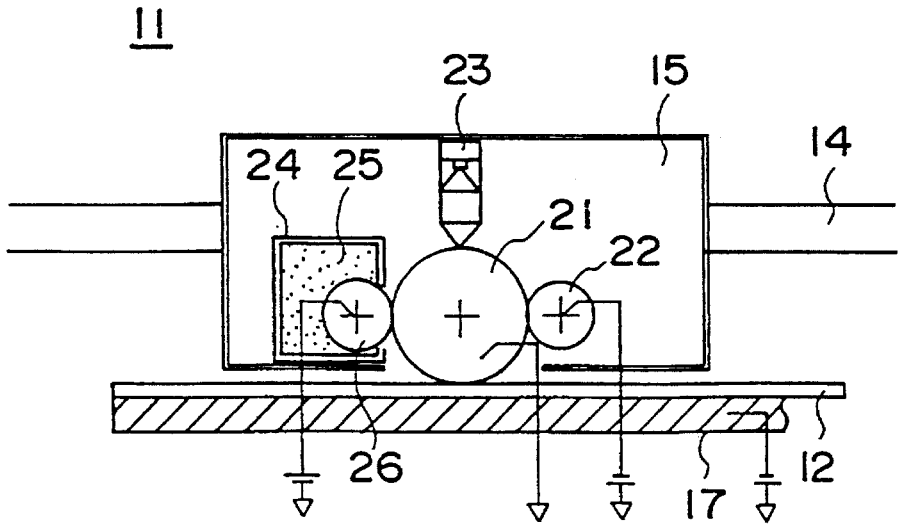
FIG. 1B PRIOR ART
Figure 2:
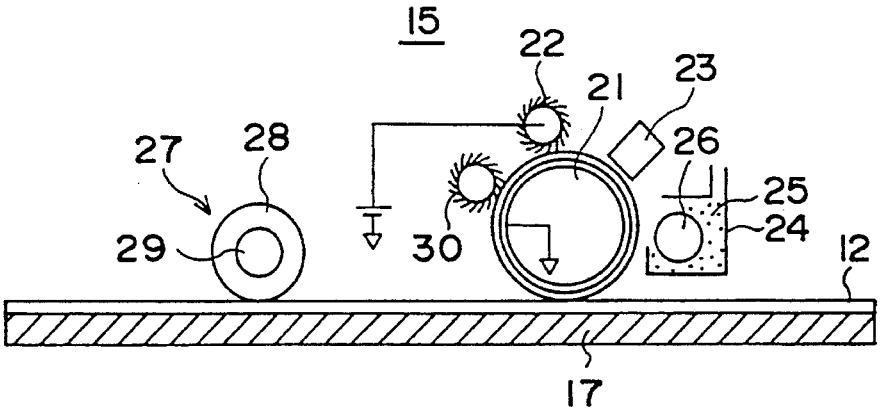
FIG. 2 PRIOR ART
FIG. 2 is a cross sectional view showing a carriage provided with a fixing unit.
Figure 3:
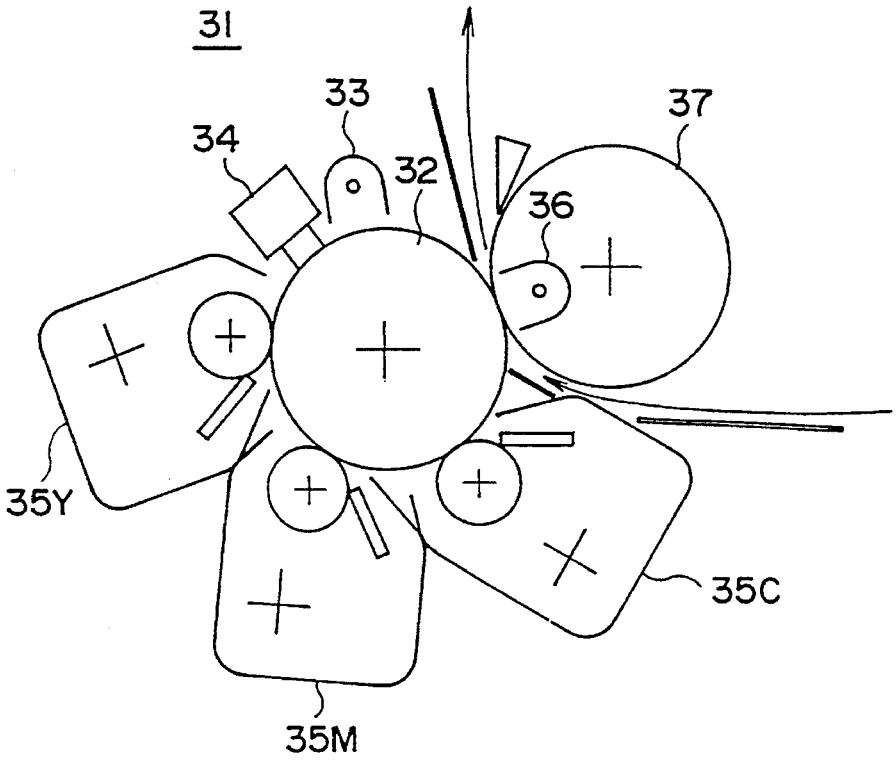
FIG. 3 PRIOR ART
FIG. 3 is a cross sectional view showing a part of a second conventional serial printer.
Figure 4A:
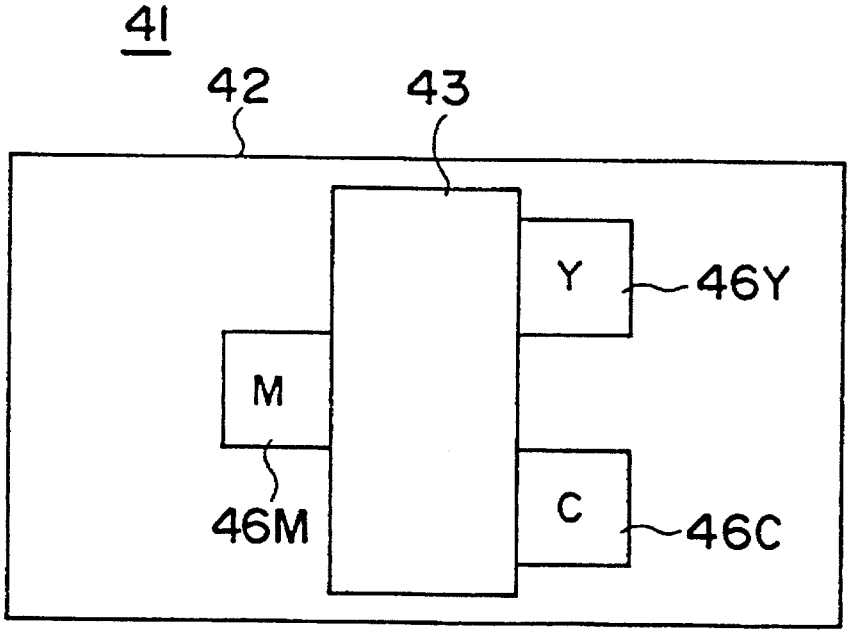
FIG. 4A PRIOR ART
FIGS. 4A and 4B respectively are a plan view and a cross sectional view showing a third conventional serial printer.
Figure 4B:
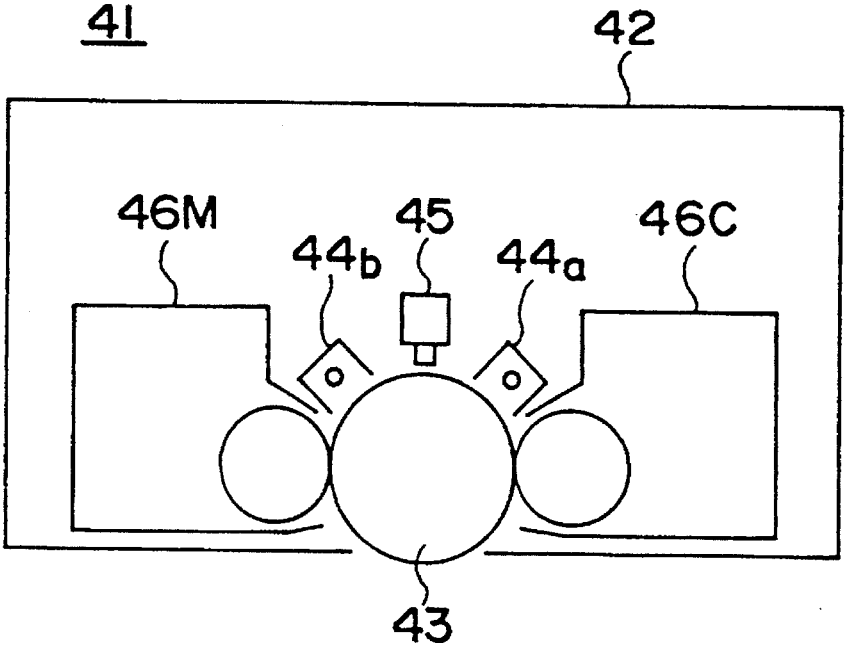
FIG. 4B PRIOR ART
Figure 5:
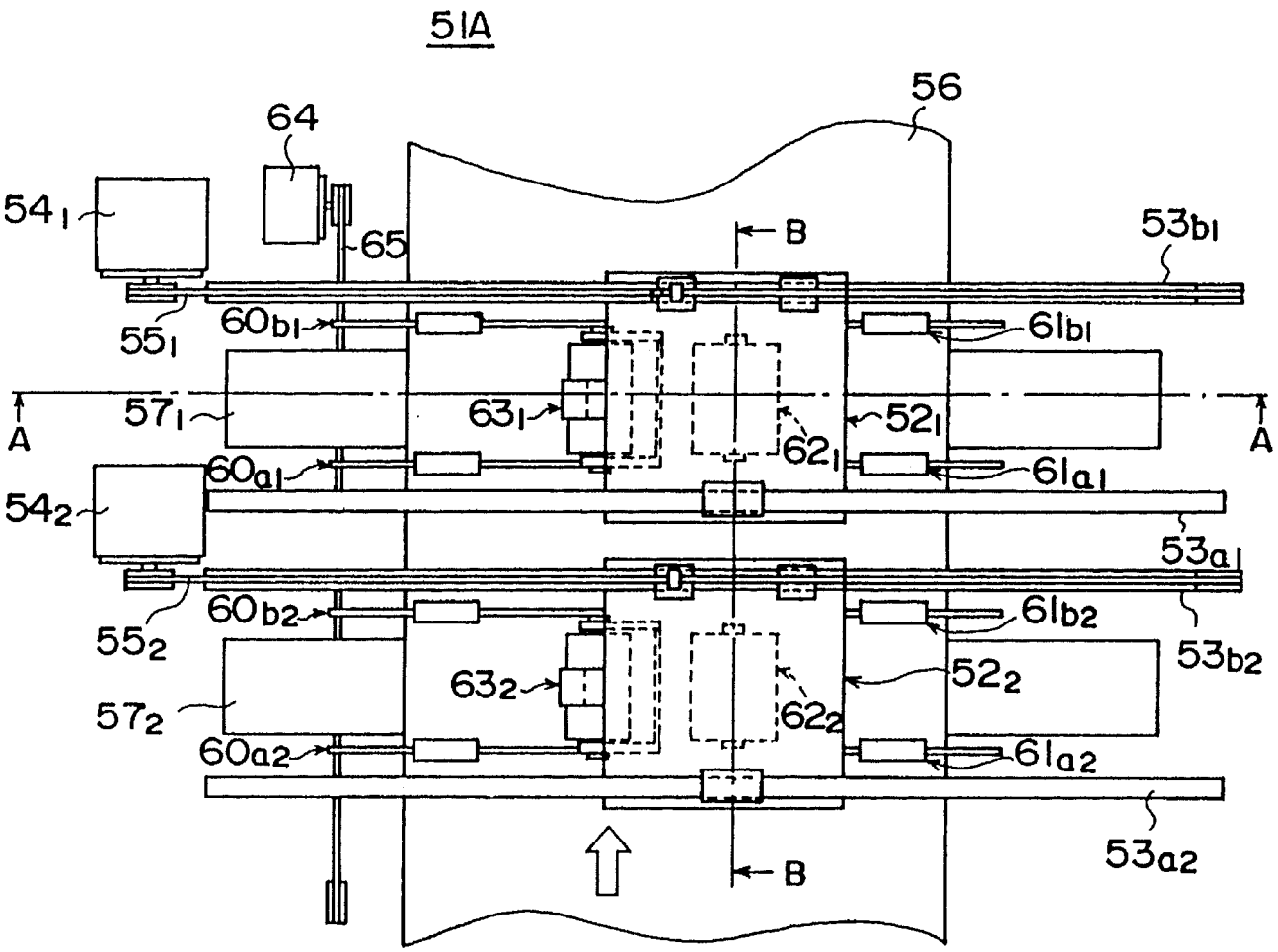
FIG. 5 is a plan view showing a first embodiment of a serial printer according to the present invention.

FIG. 5 shows a plan view of a first embodiment of a serial printer according to the present invention. A serial printer $\mathbf{51}_A$ shown in FIG. 5 includes a carriage $\mathbf{52}_1$ having a process part and a fixing unit, and a carriage $\mathbf{52}_2$ having a process part and a fixing unit. The carriage $\mathbf{52}_1$ is moved in a direction perpendicular to a sheet transport direction of a recording sheet 56 by a carrier motor $\mathbf{54}_1$ via a belt $\mathbf{55}_1$, under guidance of guide shafts $\mathbf{53}_{a1}$ and $\mathbf{53}_{b1}$. Similarly, the carriage $\mathbf{52}_2$ is moved in a direction perpendicular to the sheet transport direction of the recording sheet 56 by a carrier motor $\mathbf{54}_2$ via a belt $\mathbf{55}_2$, under guidance of guide shafts $\mathbf{53}_{a2}$ and $\mathbf{53}_{b2}$.

A transfer unit (transfer platen) $\mathbf{57}_1$ is arranged along the moving direction of the carriage $\mathbf{52}_1$ under the carriage $\mathbf{52}_1$ and between the guide shafts $\mathbf{53}_{a1}$ and $\mathbf{53}_{b1}$. Transport shafts $\mathbf{58}_{a1}$ and $\mathbf{58}_{b1}$ provided with transport rollers $\mathbf{59}_{a1}$ and $\mathbf{59}_{b1}$ are respectively provided along the carriage moving direction on the downstream and upstream sides in the sheet transport direction as shown in FIG. 6B which will be described later, and the transport rollers $\mathbf{59}_{a1}$ and $\mathbf{59}_{b1}$ transport the recording sheet 56 in the direction of an arrow in FIG. 5. Pressing shafts $\mathbf{60}_{a1}$ and $\mathbf{60}_{b1}$ are respectively arranged in a freely rotatable state above the transport shafts $\mathbf{58}_{a1}$ and $\mathbf{58}_{b1}$, and rollers $\mathbf{61}_{a1}$ and $\mathbf{61}_{b1}$ which make contact with the corresponding transport rollers $\mathbf{59}_{a1}$ and $\mathbf{59}_{b1}$ are provided on the pressing shafts $\mathbf{60}_{a1}$ and $\mathbf{60}_{b1}$. The transport rollers $\mathbf{59}_{a1}$ and $\mathbf{59}_{b1}$ are rotated by a transport motor 64 via a belt 65, and the recording sheet 56 is transported in a state pinched between the rollers $\mathbf{61}_{a1}$ and $\mathbf{61}_{b1}$ and the transport rollers $\mathbf{59}_{a1}$ and $\mathbf{59}_{b1}$.

Similarly, a transfer unit (transfer platen) $\mathbf{57}_2$ is arranged along the moving direction of the carriage $\mathbf{52}_2$ under the carriage $\mathbf{52}_2$ and between the guide shafts $\mathbf{53}_{a2}$ and $\mathbf{53}_{b2}$. Transport shafts $\mathbf{58}_{a2}$ and $\mathbf{58}_{b2}$ provided with transport rollers $\mathbf{59}_{a2}$ and $\mathbf{59}_{b2}$ are respectively provided along the carriage moving direction on the downstream and upstream sides in the sheet transport direction as shown in FIG. 6B which will be described later, and the transport rollers $\mathbf{59}_{a2}$ and $\mathbf{59}_{b2}$ transport the recording sheet 56 in the direction of an arrow in FIG. 5. Pressing shafts $\mathbf{60}_{a2}$ and $\mathbf{60}_{b2}$ are respectively arranged in a freely rotatable state above the transport shafts $\mathbf{58}_{a2}$ and $\mathbf{58}_{b2}$, and rollers $\mathbf{61}_{a2}$ and $\mathbf{61}_{b2}$ which make contact with the corresponding transport rollers $\mathbf{59}_{a2}$ and $\mathbf{59}_{b2}$ are provided on the pressing shafts $\mathbf{60}_{a2}$ and $\mathbf{60}_{b2}$. The transport rollers $\mathbf{59}_{a2}$ and $\mathbf{59}_{b2}$ are rotated by a transport motor 64 via a belt 65, and the recording sheet 56 is transported in a state pinched between the rollers $\mathbf{61}_{a2}$ and $\mathbf{61}_{b2}$ and the transport rollers $\mathbf{59}_{a2}$ and $\mathbf{59}_{b2}$.

The transfer units $\mathbf{57}_1$ and $\mathbf{57}_2$ are respectively made up of a substrate made of aluminum or the like, and a heat-resistant conductive member provided on the substrate on the side of the carriage. For example, the heat-resistant conductive member is made of silicon rubber mixed with a conductive material.

The printing assemblies having the above described construction are arranged in two rows along the sheet transport direction.

Figure 6A:
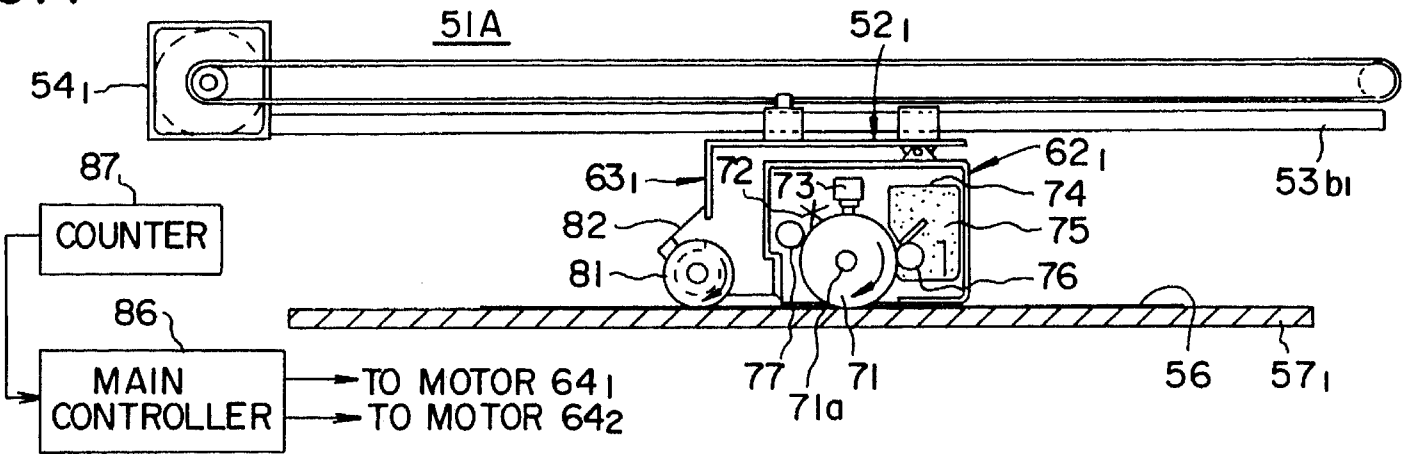
FIGS. 6A and 6B respectively are cross sectional views along lines A—A and B—B in FIG. 5.
Figure 6B:
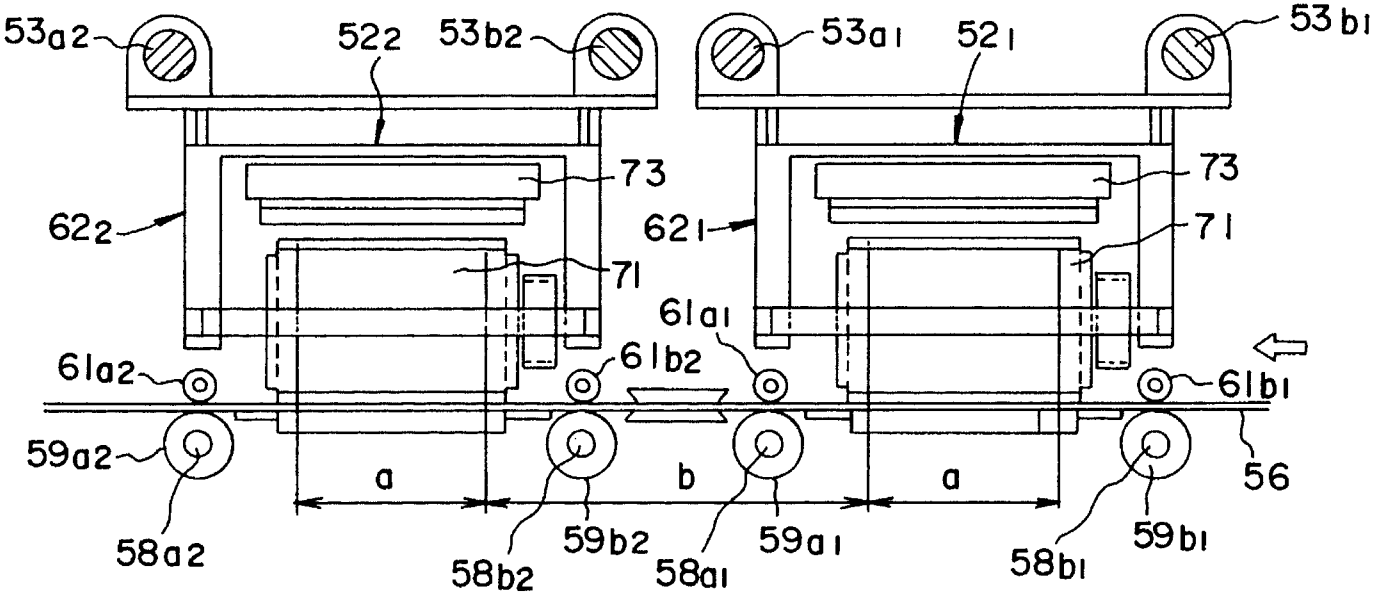
Figure 7:
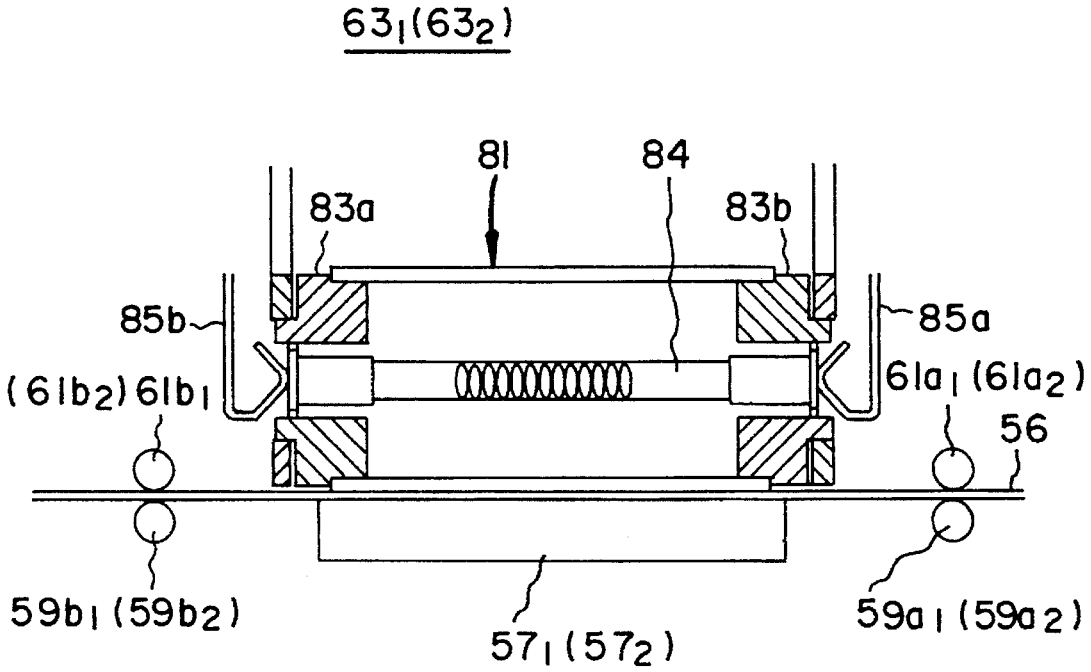
FIG. 7 is a cross sectional view showing a fixing unit of the first embodiment.

FIG. 6A shows a cross section along a line A—A in FIG. 5, and FIG. 6B shows a cross section along a line B—B in FIG. 5. In addition, FIG. 7 shows a cross section of the fixing unit shown in FIG. 5.

In FIG. 6A, the carriage $52_1$ includes a process part $62_1$ and a fixing unit $63_1$, and the carriage $52_2$ includes a process part $62_2$ and a fixing unit $63_2$. Each of the process parts $62_1$ and $62_2$ has a recording drum 71 having a rotary shaft 71*a* which is parallel to the sheet transport direction. The recording drum 71 is provided as an image bearing member, and rotates on the recording sheet 56 on the corresponding one of the transfer units $57_1$ and $57_2$ at a peripheral speed synchronized to the movement of the corresponding one of the carriages $52_1$ and $52_2$.

The surface of the recording drum 71 is uniformly charged by a charger 72, and an electrostatic latent image is formed on the charged surface by an exposing unit 73. The electrostatic latent image is visualized into a toner image by a toner 75 within a developing unit 74 and a developing roller 76. The toner image formed on the surface of the recording drum 71 is transferred onto the recording sheet 56 by applying a predetermined voltage across the recording drum 71 and the transfer units $57_1$ and $57_2$ which confront the recording drum 71 via the recording sheet 56. The developing roller 76 rotates in synchronism with the movements of the carriages $52_1$ and $52_2$.

After the image transfer, the surface of the recording drum 71 is discharged. The residual toner remaining on the surface of the recording drum 71 after the discharge is removed by a cleaner 77.

Each of the fixing units $63_1$ and $63_2$ has a fixing roller 81 and a thermistor 82. The thermistor 82 detects the temperature of the fixing roller 81 and controls the temperature of the fixing roller 81.

As shown in FIG. 7, each of the fixing units $63_1$ and $63_2$ has a halogen lamp 84 provided within the fixing roller 81. The halogen lamp 84 is provided at a central part between flanges 83*a* and 83*b* on both ends of the fixing roller 81. Terminals 85*a* and 85*b* for supplying power to the halogen lamp 84 make contact with the respective ends of the halogen lamp 84 by applying pressure thereon.

Returning now to the description of FIG. 6A, a main controller 86 controls transport motors $64_1$ and $64_2$ and controls the amount of recording sheet 56 that is transported or fed. The main controller 86 is coupled to a counter 87 which counts the number of times the printing is made. For example, the counter 87 increments the count when the carriages $52_1$ and $52_2$ return to their home positions.

As shown in FIG. 6B, the recording sheet 56 is transported by the transport rollers $59_{a1}$ and $59_{b1}$ between the transfer unit $57_1$ and the recording drum 71 of the carriage $52_1$, and is also transported by the transport rollers $59_{a2}$ and $59_{b2}$ between the transfer unit $57_2$ and the recording drum 71 of the carriage $52_2$ which is arranged in parallel to the carriage $52_1$ along the sheet transport direction.

In this case, the recording drums 71 of the carriages $52_1$ and $52_2$, that is, the process parts $62_1$ and $62_2$, have a printing width . In addition, a minimum distance between the recording drums 71 is b, and this minimum distance b is set to satisfy b=na, where n denotes an integer.

FIGS. 8A, 8B, 9A and 9B are plan views for explaining the printing operation of the first embodiment. In this embodiment, the minimum distance b is set to satisfy b=2a.

Figure 8A:
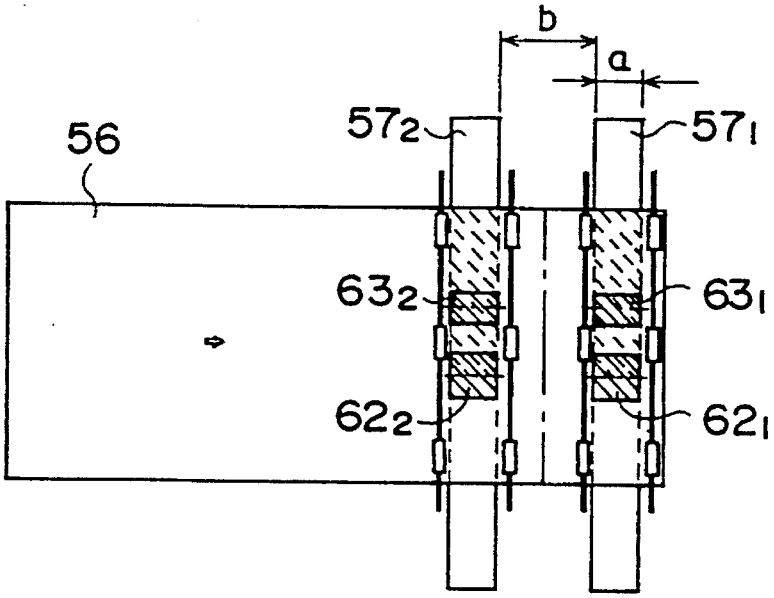
FIGS. 8A and 8B respectively are plan views for explaining the printing operation of the first embodiment.

In FIG. 8A, the main controller 86 controls the transport motor 64 to rotate and the recording sheet 56 is transported, so that the process part $62_1$ and the fixing unit $63_1$ of the carriage $52_1$ are positioned at the first (or top) line on the recording sheet 56. Then, the two carriages $52_1$ and $52_2$ move from the respective home positions in the carriage moving direction, and image information is simultaneously printed and fixed from the print start position on 2 adjacent lines having an interval (or pitch) b. When the first printing and fixing operation for the 2 adjacent lines ends, the carriages $52_1$ and $52_2$ are returned to their home positions.

Figure 8B:
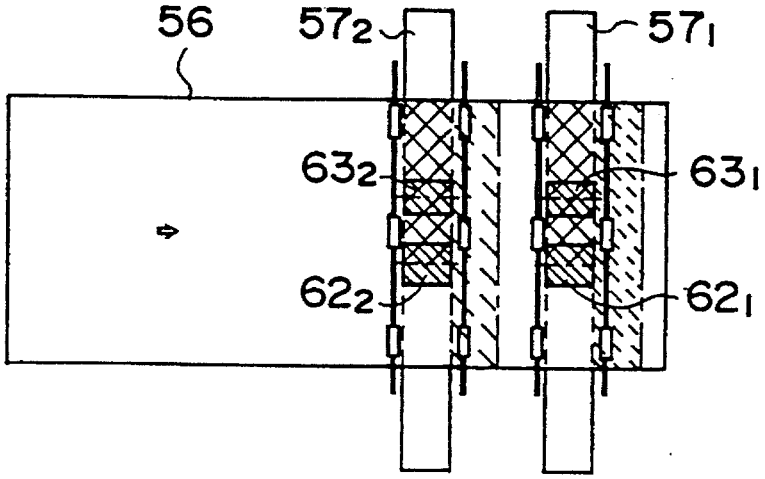

In FIG. 8B, the main controller 86 controls the transport motor 64 so that the recording sheet 56 is transported in the sheet transport direction by an amount equal to the printing width a. Then, the second printing and fixing operation is carried out for 2 adjacent lines.

Figure 9A:
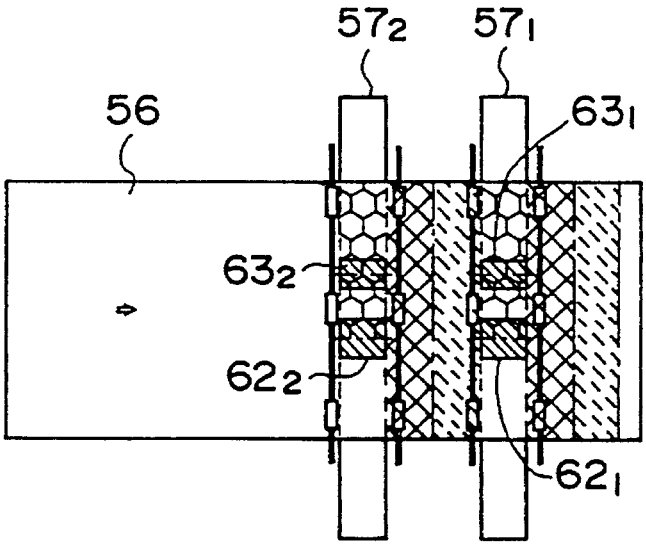
FIGS. 9A and 9B respectively are plan views for explaining the printing operation of the first embodiment.

In addition, in FIG. 9A, the recording sheet 56 is transported by the amount a in the sheet transport direction, and the third printing and fixing operation is carried out. Because the minimum distance b is set to b=2a in this case, the printed portions made by the carriages $52_1$ and $52_2$ overlap during this third printing and fixing operation. Accordingly, after the third printing and fixing operation, the main controller 86 controls the transport motor 64 so that the recording sheet 56 is transported in the sheet transport direction by an amount (2+2)×a=4a. The counter 87 counts the number of times such a printing and fixing operation is carried out, and the main controller 86 sets the amount of recording sheet 56 to be transported depending on the counted value received from the counter 87.

Figure 9B:
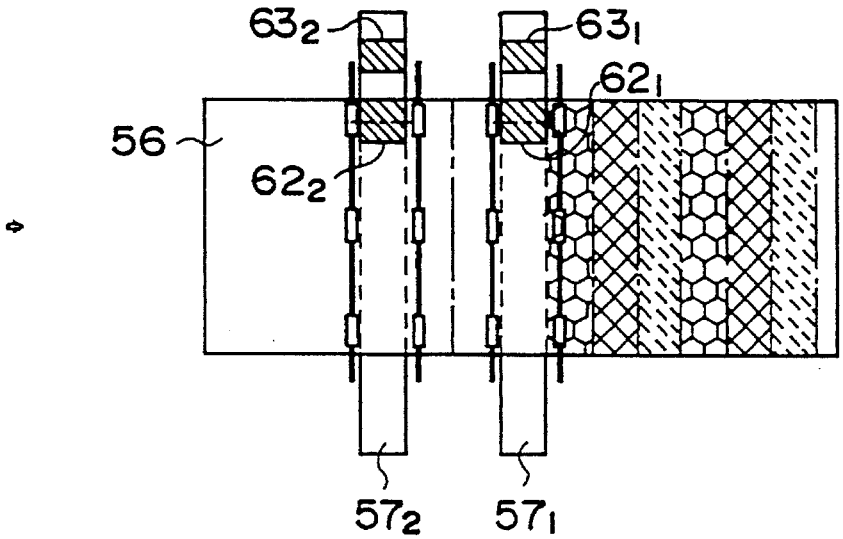

In FIG. 9B, the fourth printing and fixing operation is carried out with respect to the recording sheet 56 by moving the carriages $52_1$ and $52_2$ in the carriage moving direction.

The first, second, third and fourth printing and fixing operations described above in conjunction with FIGS. 8A, 8B, 9A and 9B are repeated until the image is printed on the entire recording sheet 56 or on the entire printing region of the recording sheet 56.

In other words, when b=na, the recording sheet 56 is transported by the amount a in the sheet transport direction every time the carriages $52_1$ and $52_2$ make one reciprocating movement, that is, move from their home positions and return to their home position. Further, the recording sheet 56 is transported by an amount 2n in the sheet transport direction for every 2n reciprocating movement of the carriages $52_1$ and $52_2$.

Therefore, it is possible to carry out a high-speed printing at a low cost by arranging the carriages $52_1$ and $52_2$ in parallel to each other.

Figure 10:
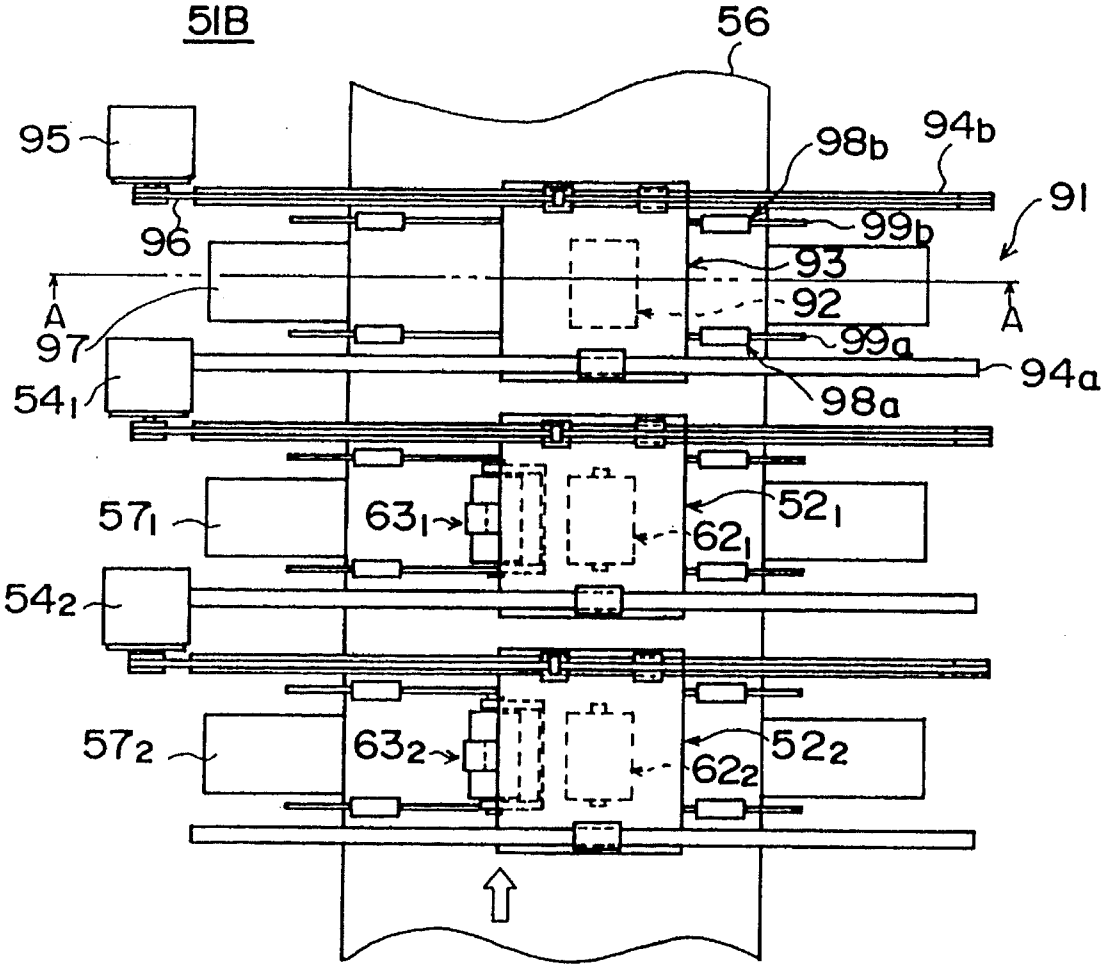
FIG. 10 is a plan view showing a second embodiment of the serial printer according to the present invention.

Next, a description will be given of a second embodiment of the serial printer according to the present invention, by referring to FIG. 10. FIG. 10 shows a plan view of the second embodiment. In FIG. 10, those parts which are the same as those corresponding parts in FIGS. 5 through 7 are designated by the same reference numerals, and a description thereof will be omitted.

A serial printer $51_B$ shown in FIG. 10 has a fixing assembly 91 arranged at a final stage along the sheet transport direction. Otherwise, the construction of the serial printer $51_B$ is basically the same as that of the serial printer $51_A$.

The fixing assembly 91 includes a fixing carriage 93 provided with a fixing unit 92. The fixing carriage 93 is guided by guide shafts 94*a* and 94*b* and is driven by a moving motor 95 via a belt 96 so that the fixing carriage 93 moves in a direction perpendicular to the sheet transport direction. A fixing pad 97 is arranged under the fixing unit 92 along the moving direction of the fixing carriage 93. Transport rollers (not visible in FIG. 10), and pressing shafts 99*a* and 99*b* respectively having rollers 98*a* and 98*b* are arranged on the upstream and downstream sides of the fixing pad 97 in the sheet transport direction.

Figure 11:
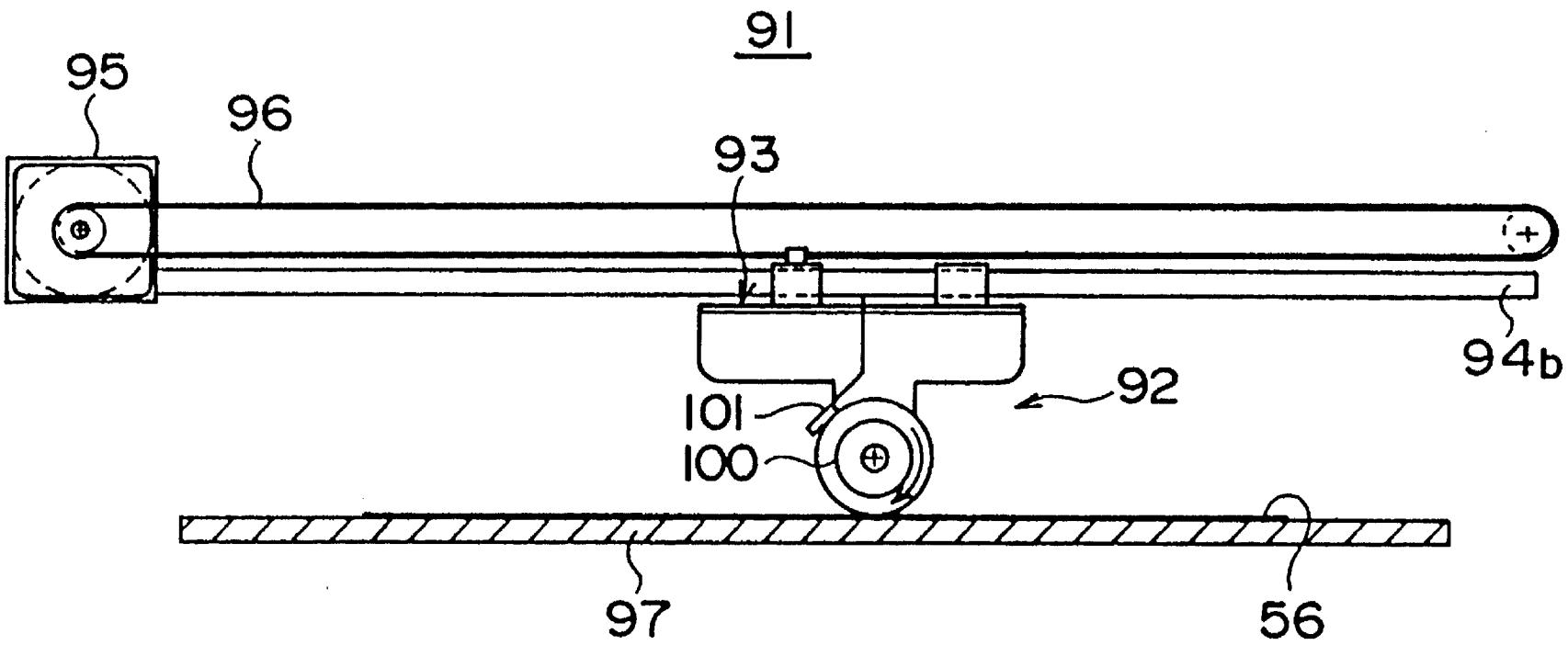
FIG. 11 is a cross sectional view along a line A—A in FIG. 10.

FIG. 11 shows a cross section of the second embodiment along a line A—A in FIG. 10. In FIG. 11, the fixing unit 92 has a fixing roller 100 and a thermistor 101. The fixing roller 100 has a halogen lamp as a heating means, and the thermistor 101 detects and controls the temperature of the fixing roller 100. The fixing unit 92 may have the same construction as the fixing unit shown in FIG. 7. In this case, when the fixing roller 100 has a fixing length a, the fixing roller 100 is arranged at a distance b from the recording drum 71 of the process part $\mathbf{63}_1$ in the preceding stage, where this distance b is described by b=na.

The temperature of the fixing roller 100 is set higher than the other fixing rollers 81. In addition, the fixing roller 100 is pushed towards the recording sheet 56 by a spring (not shown) or the like.

In the serial printer $\mathbf{51}_B$, the image that is fixed on the recording sheet 56 by the fixing units $\mathbf{63}_1$ and $\mathbf{63}_2$ in the preceding stages is further fixed by the fixing roller 100 of the fixing unit 92 as the fixing carriage 93 moves. In addition, the fixing unit 92 is only moved one way for each reciprocating movement of the carriages $\mathbf{52}_1$ and $\mathbf{52}_2$, and the time in which the fixing carriage 93 moves one way is set equal to the time in which the carriages $\mathbf{52}_1$ and $\mathbf{52}_2$ make one reciprocating movement. Hence, it is possible to make the total fixing time longer without reducing the printing speed.

By carrying out the fixing again by the fixing roller 100, it is possible to improve the fixing strength and to improve the printing quality.

The fixing carriage 93 does not have a process part. For this reason, it is possible to increase the diameter of the fixing roller 100 compared to the fixing roller 81, and to increase the nip width of the fixing roller 100 with respect to the recording sheet 56, so that the fixing strength is further improved.

Figure 12:
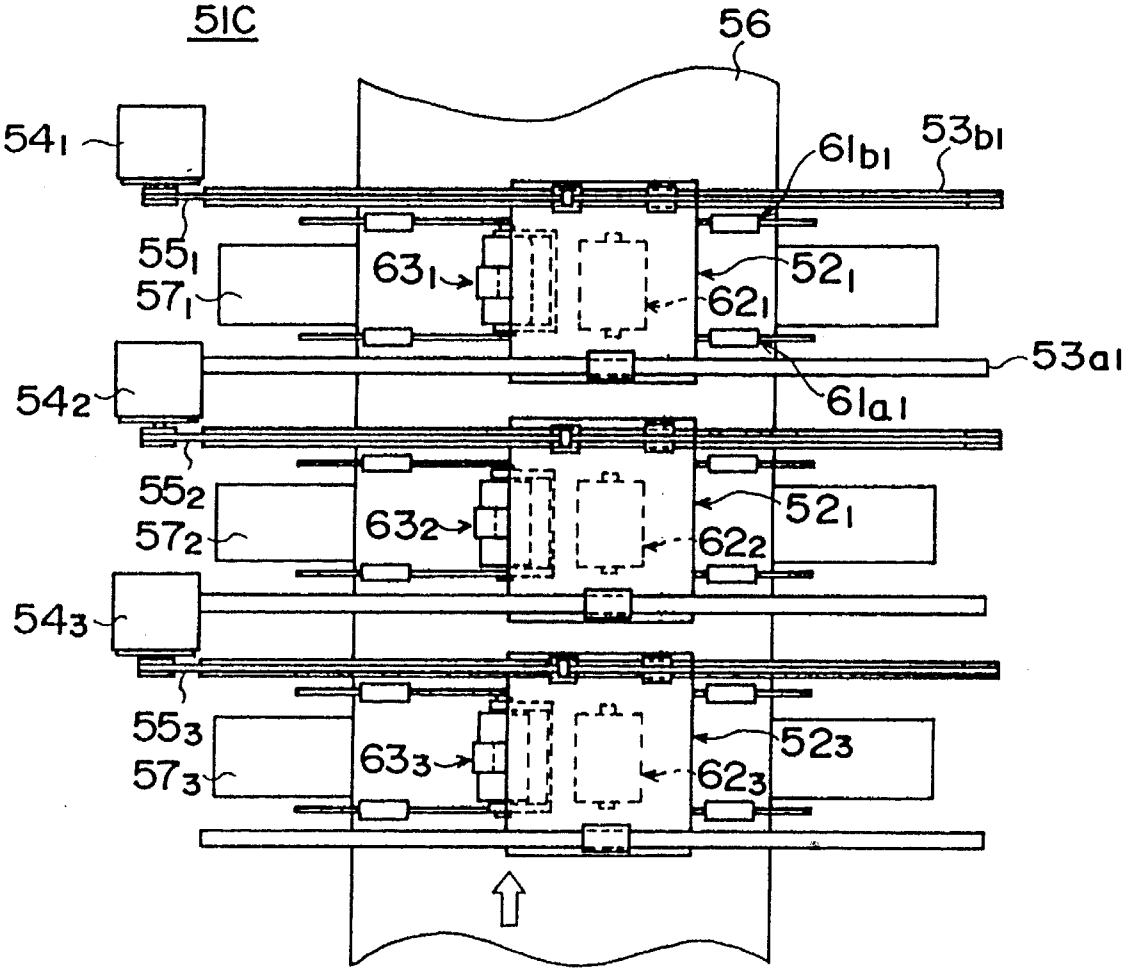
FIG. 12 is a plan view showing a third embodiment of the serial printer according to the present invention.

Next, a description will be given of a third embodiment of the serial printer according to the present invention, by referring to FIG. 12. FIG. 12 shows a plan view of the third embodiment. In FIG. 12, those parts which are the same as those corresponding parts in FIGS. 5 through 7 are designated by the same reference numerals, and a description thereof will be omitted.

A serial printer $\mathbf{51}_C$ shown in FIG. 12 has printing assemblies which are basically the same as that of the first embodiment, and the printing assemblies are arranged at the same pitch in the sheet transport direction. As a result, it is possible to further increase the printing speed with respect to one recording sheet 56.

In the serial printer $\mathbf{51}_C$, it is possible to print a monochrome image by filling a single color toner 75 in the developing units 74 of each of the process parts $\mathbf{62}_1$ through $\mathbf{62}_3$. For example, a black-and-white image can be printed by use of a black toner 75 when the recording sheet 56 is white. On the other hand, it is possible to print a color image by filling toners 75 having different colors such as cyan, magenta and yellow in the developing units 74 of each of the process parts $\mathbf{62}_1$ through $\mathbf{62}_3$.

Figure 13:
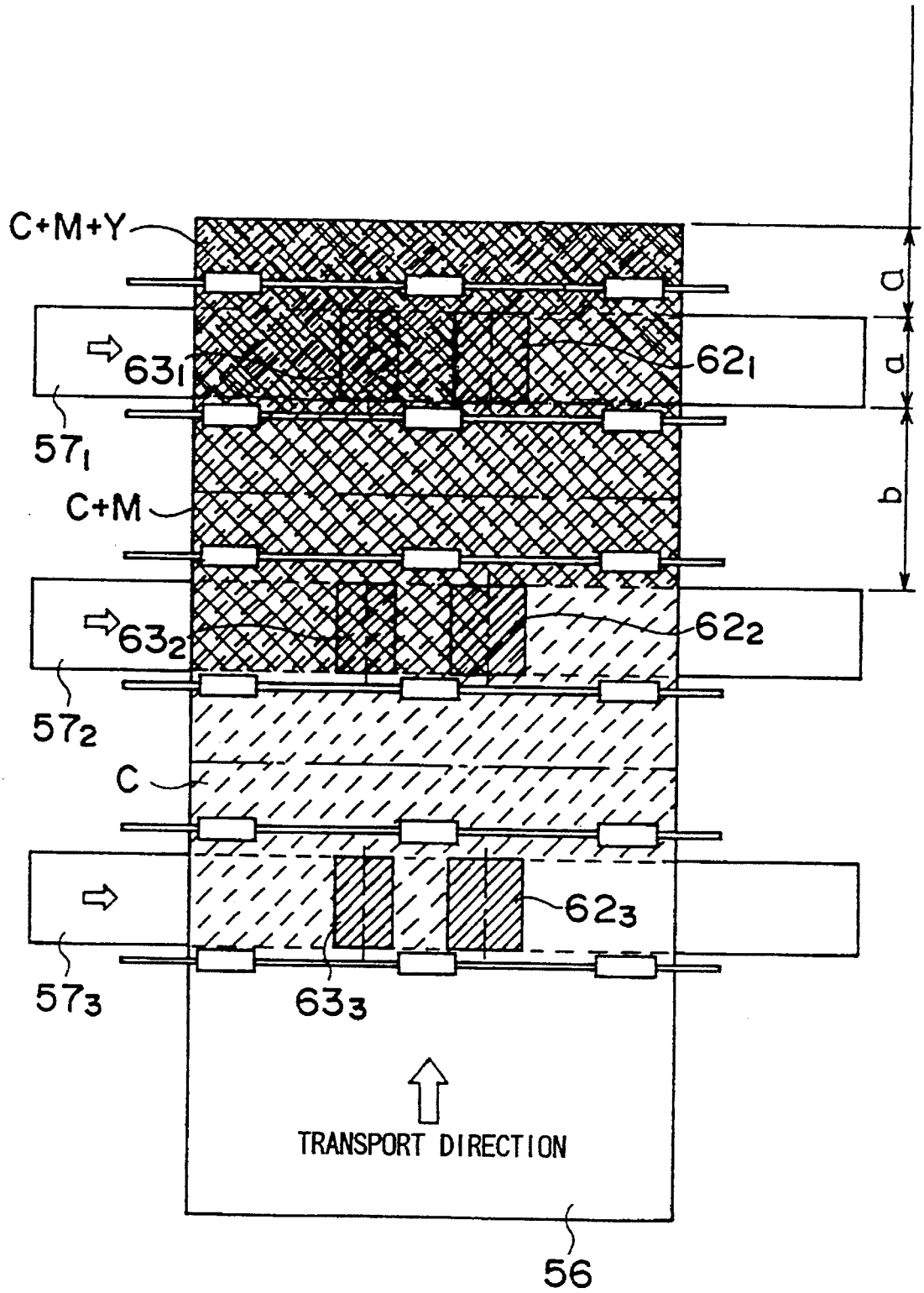
FIG. 13 is a plan view for explaining the color printing operation of the third embodiment.

FIG. 13 is a plan view for explaining the color printing operation of this third embodiment. In FIG. 13, the printing is carried out with respect to the recording sheet 56 that is transported, and a cyan image is first printed by the process part $\mathbf{62}_3$ having a cyan toner $\mathbf{75}_C$ filled therein and the fixing unit $\mathbf{63}_3$. The portion of the recording sheet 56 printed with the cyan image is transported and a magenta image is then printed thereon by the process part $\mathbf{62}_2$ having a magenta toner $\mathbf{75}_M$ filled therein and the fixing unit $\mathbf{63}_2$. The portion of the recording sheet 56 printed with the cyan and magenta images is transported and a yellow image is then printed thereon by the process part $\mathbf{62}_1$ having a yellow toner $\mathbf{75}_Y$ filled therein and the fixing unit $\mathbf{63}_1$. As a result, the cyan, magenta and yellow images are overlapped so as to form a color image on the recording sheet 56. An image of a desired color can be printed on the recording sheet 56 by stopping the printing at the portion of the recording sheet 56 where the printing is unnecessary.

Figure 14:
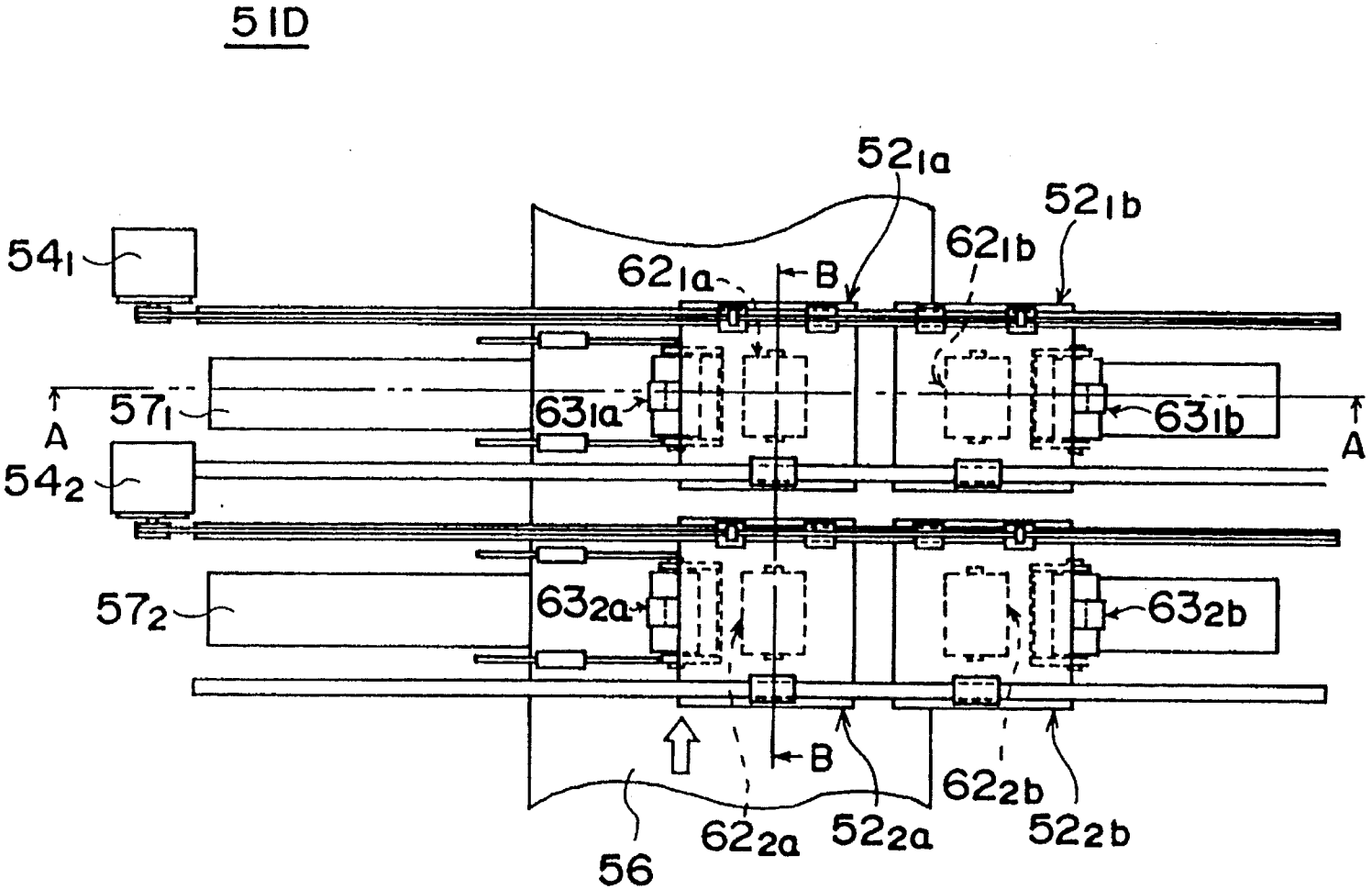
FIG. 14 is a plan view showing a fourth embodiment of the serial printer according to the present invention.

Next, a description will be given of a fourth embodiment of the serial printer according to the present invention, by referring to FIG. 14. FIG. 14 shows a plan view of the fourth embodiment. In FIG. 14, those parts which are the same as those corresponding parts in FIGS. 5 through 7 are designated by the same reference numerals, and a description thereof will be omitted.

A serial printer $\mathbf{51}_D$ shown in FIG. 14, first carriages $\mathbf{52}_{1a}$ and $\mathbf{52}_{2a}$ respectively correspond to the carriages $\mathbf{52}_1$ and $\mathbf{52}_2$ of the printing assemblies shown in FIG. 5. The first carriages $\mathbf{52}_{1a}$ and $\mathbf{52}_{2a}$ respectively have process parts $\mathbf{62}_{1a}$ and $\mathbf{62}_{2a}$ and fixing units $\mathbf{63}_{1a}$ and $\mathbf{63}_{2b}$. In addition, second carriages $\mathbf{63}_{1b}$ and $\mathbf{63}_{2b}$ are respectively provided adjacent to the first carriages $\mathbf{63}_{1a}$ and $\mathbf{63}_{2a}$ in the carriage moving direction. The second carriages $\mathbf{63}_{1b}$ and $\mathbf{63}_{2b}$ respectively have process parts $\mathbf{62}_{1b}$ and $\mathbf{62}_{2b}$ and fixing units $\mathbf{63}_{1b}$ and $\mathbf{63}_{2b}$ that are the same as the process parts $\mathbf{62}_{1a}$ and $\mathbf{62}_{2a}$ and fixing units $\mathbf{63}_{1a}$ and $\mathbf{63}_{2a}$ of the first carriages $\mathbf{63}_{1a}$ and $\mathbf{63}_{2a}$. The arrangement of the printing assemblies is the same as that shown in FIG. 5, and b=2a.

In this case, the fixing units $\mathbf{63}_{1b}$ and $\mathbf{63}_{2b}$ of the second carriages $\mathbf{52}_{1b}$ and $\mathbf{52}_{2b}$ are arranged on the downstream side in the carriage moving direction in which the carriages are first moved from the home positions, as opposed to the fixing units $\mathbf{63}_{1a}$ and $\mathbf{63}_{2a}$ of the first carriages $\mathbf{52}_{1a}$ and $\mathbf{52}_{2a}$ which are arranged on the upstream side, that is, on the home position side. As will be described later in conjunction with FIG. 15B, recession mechanisms are provided with respect to the first and second carriages $\mathbf{52}_{1a}$, $\mathbf{52}_{2a}$, $\mathbf{52}_{1b}$ and $\mathbf{52}_{2b}$ for making the process parts $\mathbf{62}_{1a}$, $\mathbf{62}_{2a}$, $\mathbf{62}_{1b}$ and $\mathbf{62}_{2b}$ of these carriages recede and separate from the recording sheet 56.

Figure 15A:
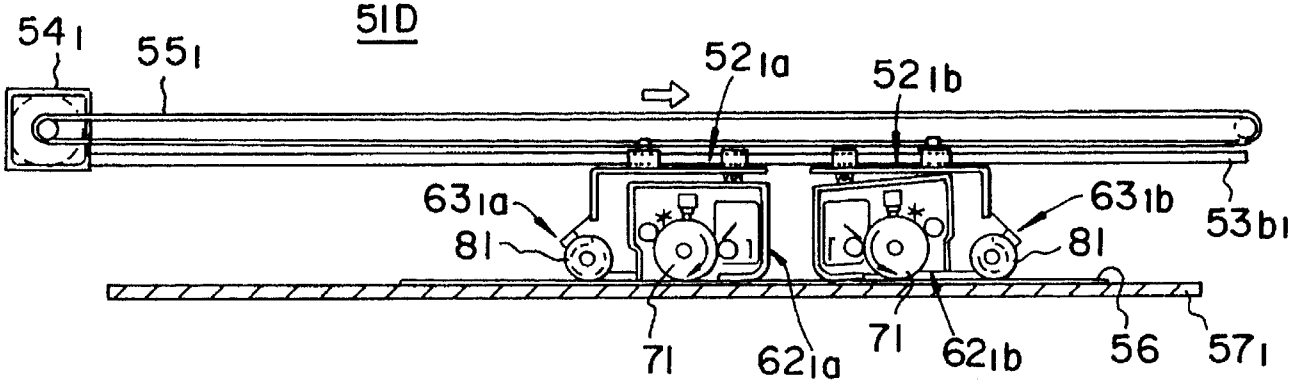
FIGS. 15A and 15B respectively are cross sectional views along lines A—A and B—B in FIG. 14.
Figure 15B:
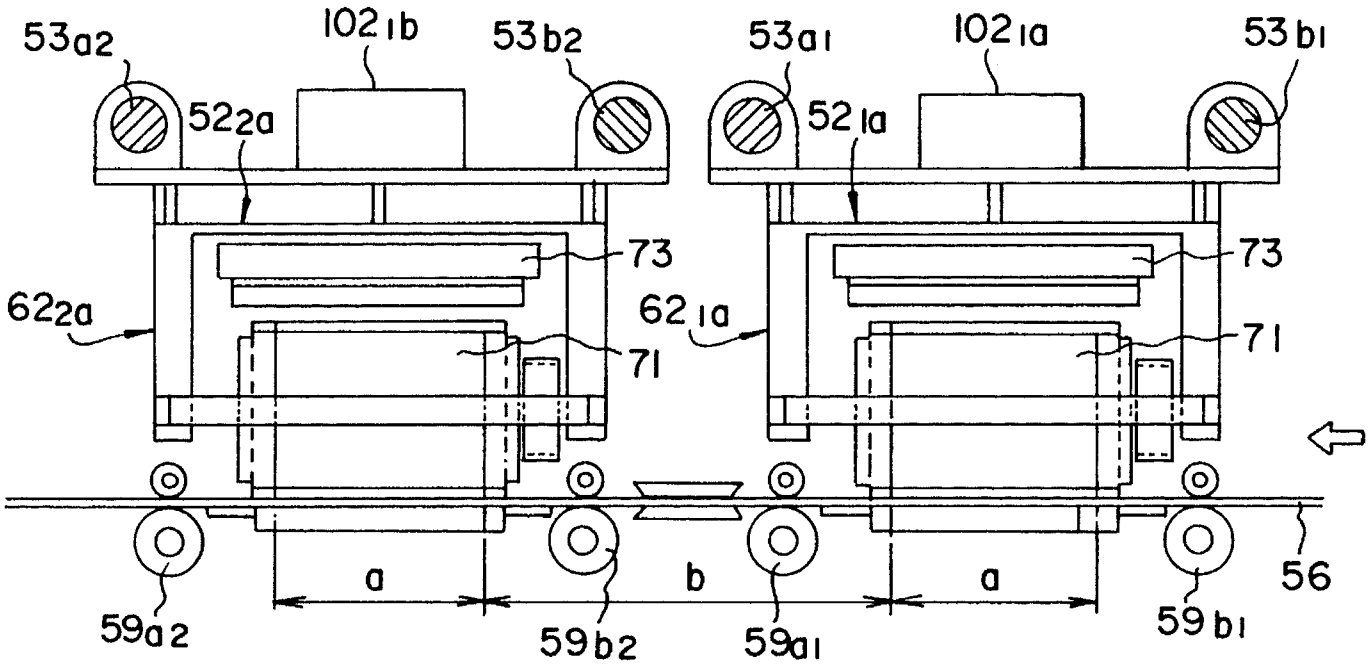

FIG. 15A shows a cross section along a line A—A in FIG. 14, and FIG. 15B shows a cross section along a line B—B in FIG. 14.

In FIG. 15A, the first and second carriages $\mathbf{52}_{1a}$ and $\mathbf{52}_{1b}$ are arranged in the carriage moving direction, and are simultaneously moved by the carrier motor $\mathbf{54}_1$ via the belt $\mathbf{55}_1$.

As shown in FIG. 15B, recession mechanisms $\mathbf{102}_{1a}$, $\mathbf{102}_{2a}$, $\mathbf{1021}_{1b}$ and $\mathbf{102}_{2b}$ ($\mathbf{102}_{1b}$ and $\mathbf{102}_{2b}$ not visible in FIG. 15B) are provided in the first and second carriages $\mathbf{52}_{1a}$, $\mathbf{52}_{2a}$, $\mathbf{52}_{1b}$ and $\mathbf{52}_{2b}$ for making the recording drums 71 of the process parts $\mathbf{62}_{1a}$, $\mathbf{62}_{2a}$, $\mathbf{62}_{1b}$ and $\mathbf{62}_{2b}$ of these carriages recede and separate from the recording sheet 56. The illustration of the recession mechanisms $\mathbf{102}_{1a}$, $\mathbf{102}_{2a}$, $\mathbf{102}_{1b}$ and $\mathbf{102}_{2b}$ is omitted in FIGS. 14 and 15A.

FIGS. 16A, 16B, 17A and 17B are cross sectional views for explaining the operation of this fourth embodiment. The printing operation of one printing assembly will be described in conjunction with FIGS. 16A through 17B.

Figure 16A:
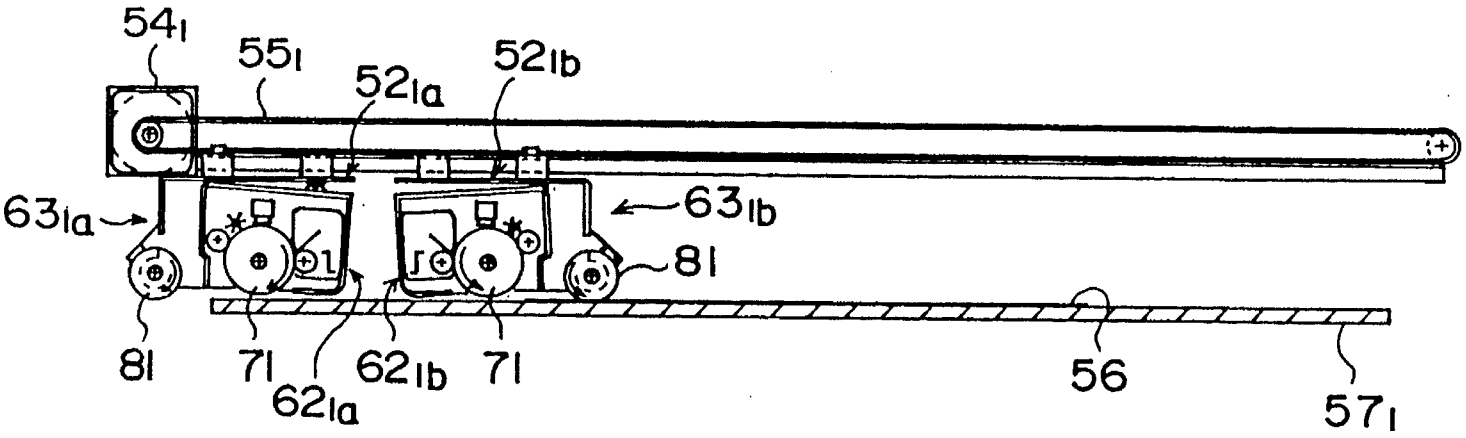
FIGS. 16A and 16B respectively are cross sectional views for explaining the operation of the fourth embodiment.

In FIG. 16A, when the first and second carriages $\mathbf{52}_{1a}$ and $\mathbf{52}_{1b}$ are located at their home positions, the recording drums 71 of the process parts $\mathbf{62}_{1a}$ and $\mathbf{62}_{1b}$ are put into the receded state by the operation of the recession mechanisms $\mathbf{102}_{1a}$ and $\mathbf{102}_{1b}$. In other words, the recording drums 71 are separated from the recording sheet 56.

Figure 16B:
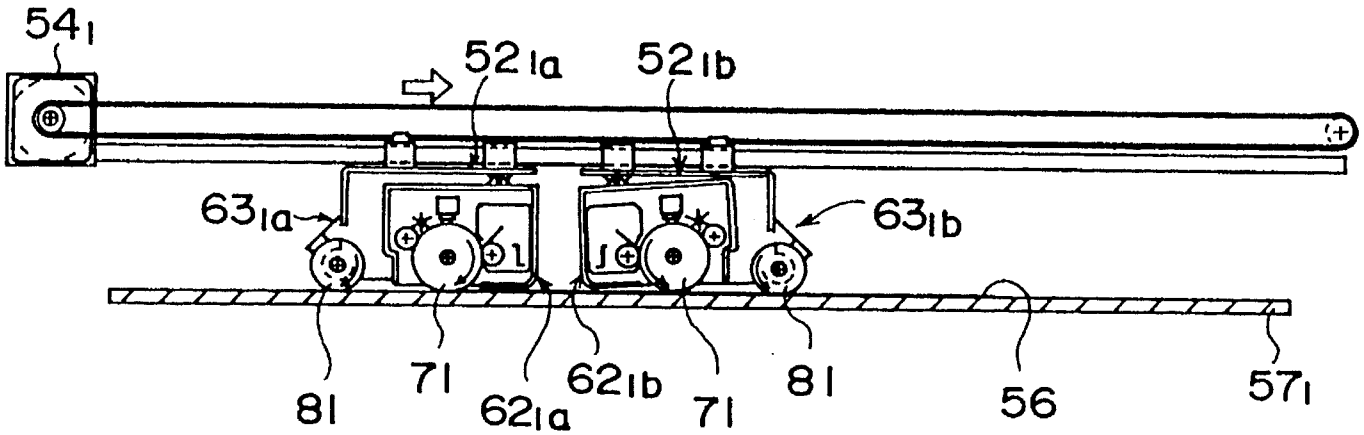

In FIG. 16B, when the first and second carriages $\mathbf{52}_{1a}$ and $\mathbf{52}_{1b}$ move in the carriage moving direction as indicated by an arrow, only the first carriage $\mathbf{52}_{1a}$ is cancelled of its receded state, and the printing is carried out with respect to the recording sheet 56 only by the first carriage $52_{1a}$ as the first carriage $52_{1a}$ travels in the going path from the home position.

Figure 17A:
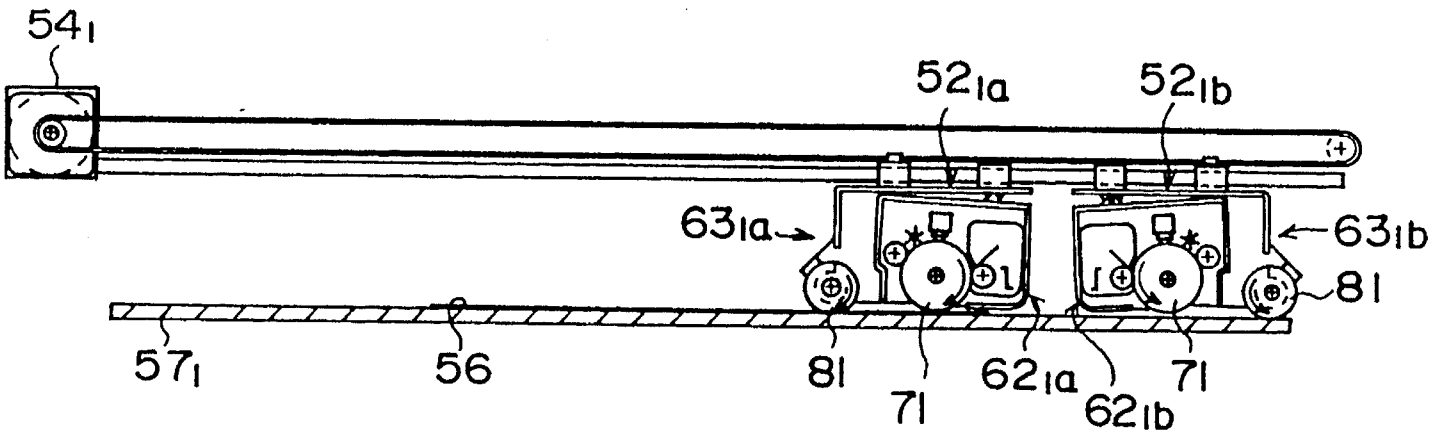
FIGS. 17A and 17B respectively are cross sectional views for explaining the operation of the fourth embodiment.

In FIG. 17A, the first carriage $52_{1a}$ is put into the receded state.

Figure 17B:
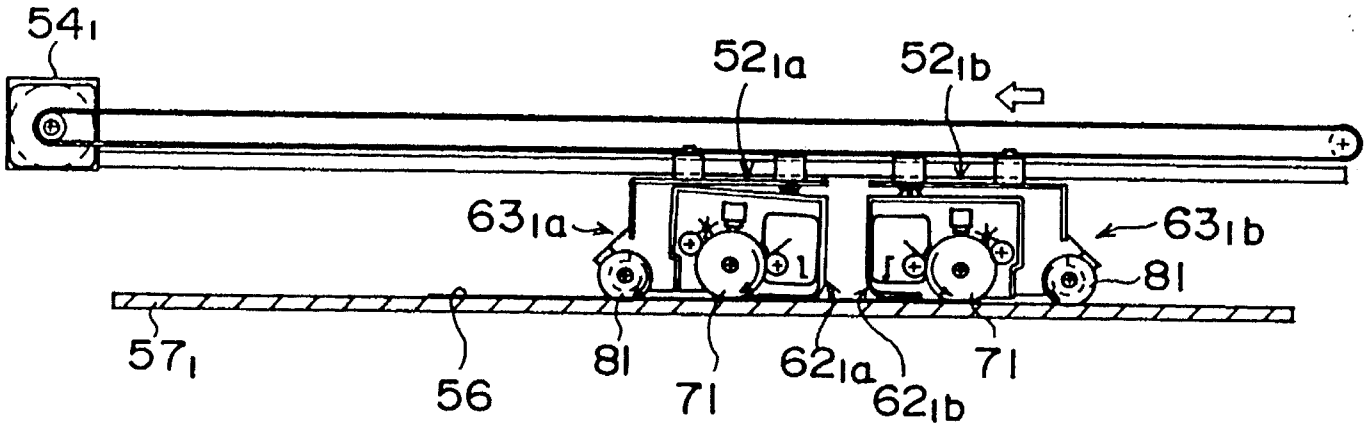

Then, in FIG. 17B, the second carriage $52_{1b}$ is cancelled of its receded state, and the printing is carried out with respect to the recording sheet 56 only by the second carriage $52_{1b}$ as the second carriage $52_{1b}$ travels in the returning path towards the home position.

In this state, if the recording sheet 56 is not transported in FIG. 17A, the printing is carried out by both the first carriage $52_{1a}$ and the second carriage $52_{1b}$, and a composite image is printed by the overlap printing. Hence, in this case, the recording sheet 56 is transported by an amount equal to the printing width a, similarly to the case shown in FIG. 5, when 1 reciprocating movement of the first and second carriages $52_{1a}$ and $52_{1b}$ ends, thereby enabling the next printing operation to start.

On the other hand, when the recording sheet 56 is transported by the amount equal to the printing width a in FIG. 17A, the printing of the next line is carried out by the second carriage $52_{1b}$ as the second carriage $52_{1b}$ travels in the returning path towards the home position. In other words, a width amounting to 2a can be printed by the first and second carriages $52_{1a}$ and $52_{1b}$ of one printing assembly as this one printing assembly undergoes one reciprocating movement, and thus, it is possible to carry out a high-speed printing. In this case, after the printing amounting to a width 3a is made, the recording sheet 56 is transported by an amount equal to 6a, so as to start a new printing operation.

In the serial printer $51_D$ described above, a single color toner 75 may be provided in the four process parts $62_{1a}$, $62_{2a}$, $62_{1b}$ and $62_{2b}$. Furthermore, it is possible to provide toners 75 having different colors such as black, cyan, magenta and yellow in the four process parts $62_{1a}$, $62_{2a}$, $62_{1b}$ and $62_{2b}$, so as to obtain a color image by printing images of different colors so as to overlap each other.

Next, a description will be given of the operation of a modification of the fourth embodiment, by referring to FIG. 18.

Figure 18:
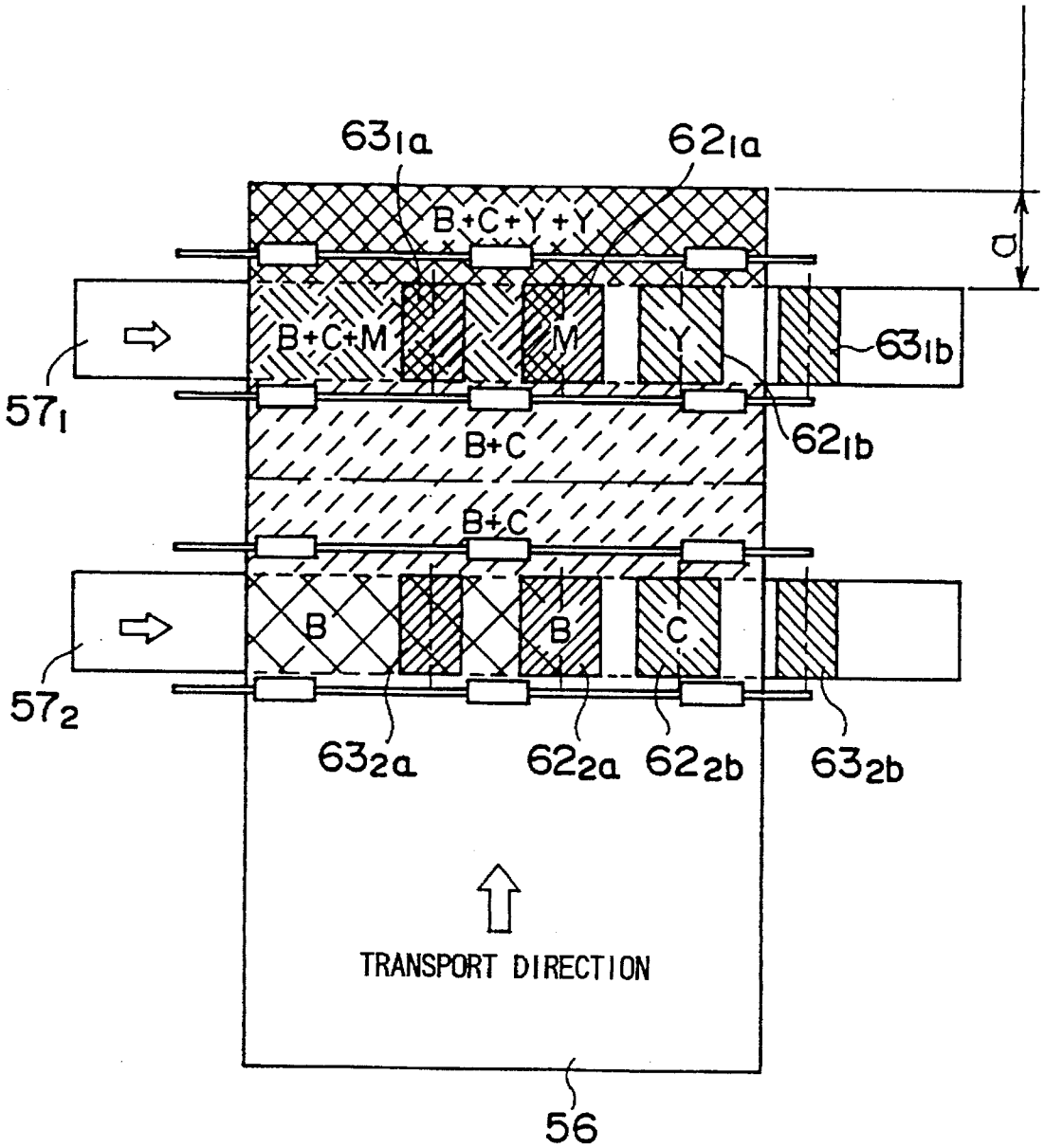
FIG. 18 is a plan view for explaining the operation of a modification of the fourth embodiment.

In FIG. 18, magenta toner is provided in the process part $62_{1a}$, yellow toner is provided in the process part $62_{1b}$, black toner is provided in the process part $62_{2a}$, and cyan toner is provided in the process part $62_{2b}$.

With respect to the recording sheet 56 that is transported in the sheet transport direction, the process part $62_{2b}$ prints in black in the going path and the process part $62_{2b}$ prints in cyan in the returning path, thereby printing a composite image of black and cyan. This portion having the composite image of black and cyan is moved by a distance 2a as the recording sheet 56 is transported in the sheet transport direction, and thereafter, the process part $62_{1a}$ prints in magenta in the going path and the process part $62_{1b}$ prints in yellow in the returning path, thereby printing a composite image of magenta and yellow over the composite image of black and cyan. Therefore, a color image is printed on the recording sheet 56 by the overlap of the black, cyan, magenta and yellow images.

Therefore, according to this modification of the fourth embodiment, it is possible to realize a compact and inexpensive line type color printer which can print color images at a high speed.

Figure 19:
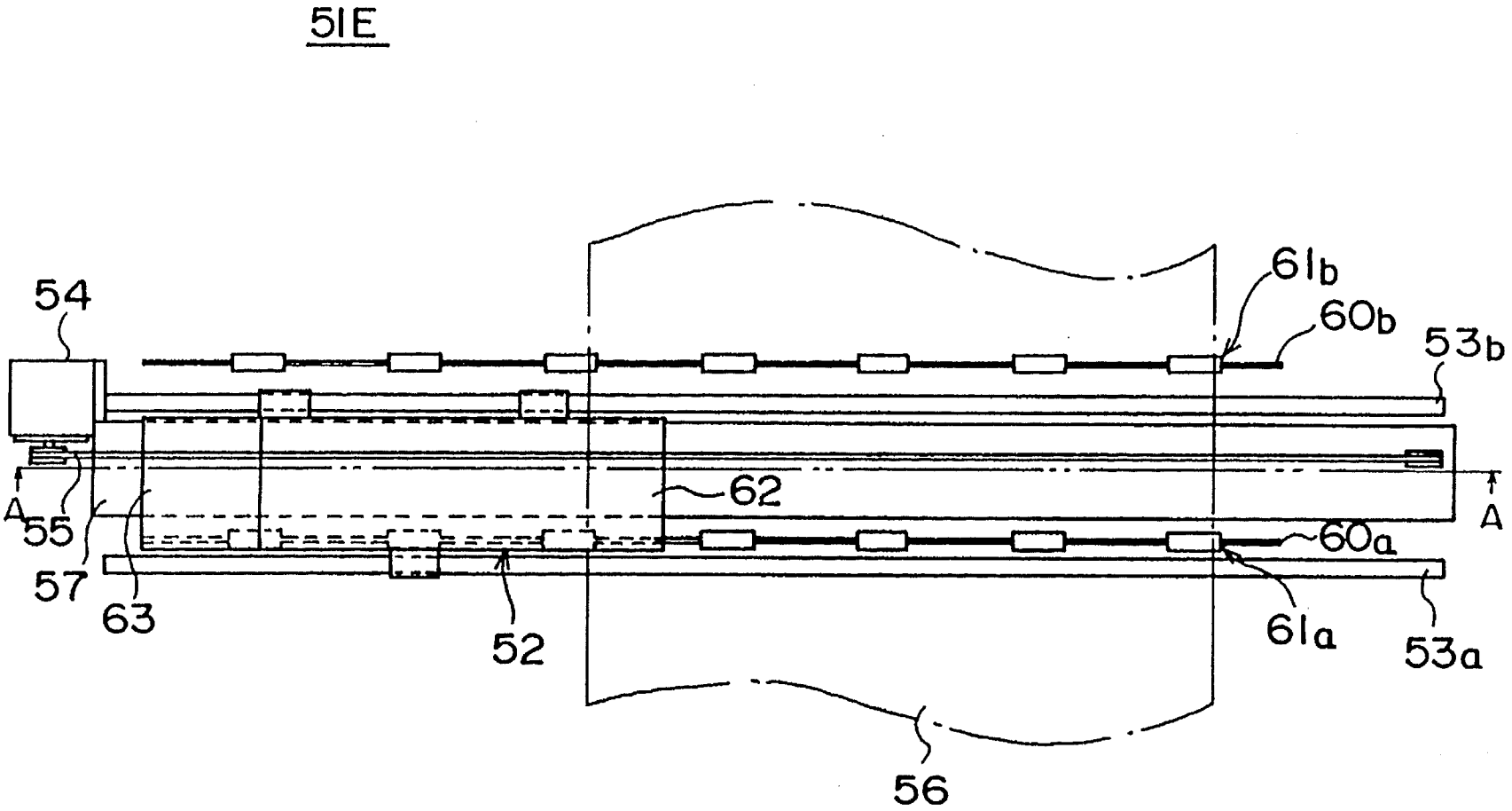
FIG. 19 is a plan view showing a fifth embodiment of the serial printer according to the present invention.

Next, a description will be given of a fifth embodiment of the serial printer according to the present invention, by referring to FIG. 19. FIG. 19 shows a plan view of the fifth embodiment. In FIG. 19, those parts which are the same as those corresponding parts in FIGS. 5 through 7 are designated by the same reference numerals, and a description thereof will be omitted.

A serial printer $51_E$ shown in FIG. 19 has the process parts $62_1$ through $62_3$ arranged at predetermined intervals in the sheet transport direction. The process parts $62_1$ through $62_3$ are shown in more detail in FIG. 20 which will be described later, and the process parts $62_1$ through $62_3$ are merely indicated by a reference numeral 62 in FIG. 19. In addition, the carriage 52 provided with the fixing unit 63 is guided by the guide shafts 53*a* and 53*b* and is moved in a direction perpendicular to the sheet transport direction by the carrier motor 54 via the belt 55.

The transfer unit (transfer platen) 57 is arranged under the carriage 52 between the guide shafts 53*a* and 53*b* along the moving direction of the carriage 52. Transport shafts (not visible in FIG. 19) having transport rollers are provided along the carriage moving direction on both the upstream and downstream sides of the transfer unit 57 in the sheet transport direction. The pressing shafts 60*a* and 60*b* are arranged above the transport shafts (transport rollers) to extend in the carriage moving direction, in a state where these pressing shafts 60*a* and 60*b* are freely rotatable. The rollers 61*a* and 61*b* which make contact with the transport rollers are provided on the respective pressing shafts 60*a* and 60*b*. The transport rollers are rotated by a transport motor (not shown), and the recording sheet 56 is transported in a state where the recording sheet 56 is pinched between the transport rollers and the rollers 61*a* and 61*b*.

On the other hand, the transfer unit 57 is made up of a substrate made of aluminum or the like, and a heat-resistant conductive member provided on the substrate on the side of the carriage. For example, the heat-resistant conductive member is made of silicon rubber mixed with a conductive material.

Figure 20:
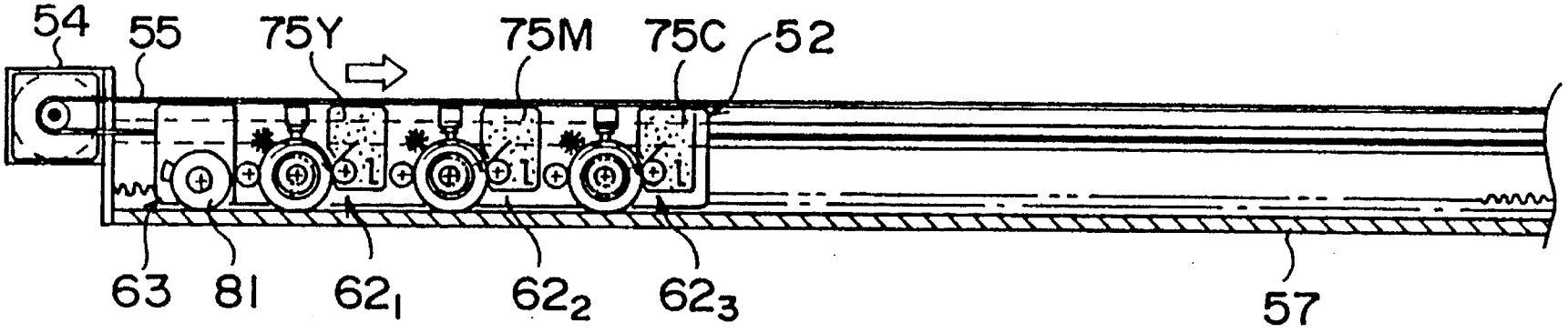
FIG. 20 is a cross sectional view along a line A—A in FIG. 19.
Figure 21:
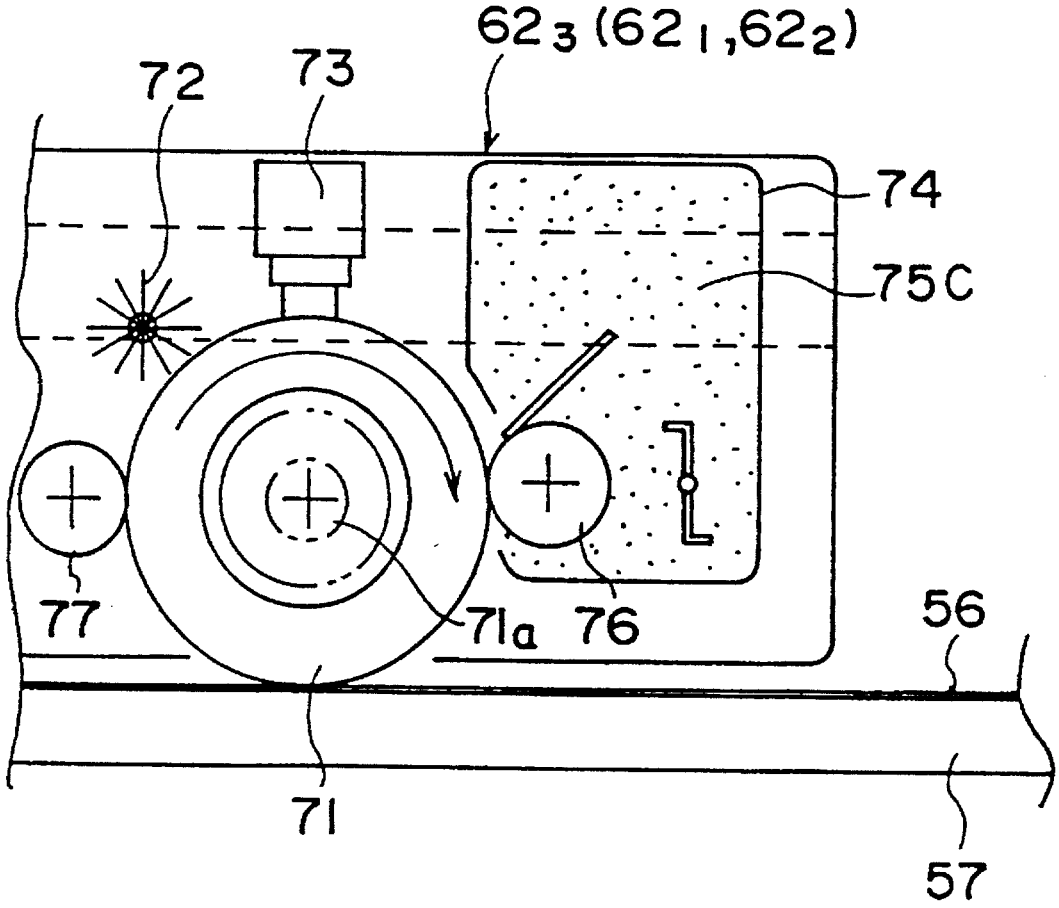
FIG. 21 is a cross sectional view showing a process part of the fifth embodiment.

FIG. 20 shows a cross section along a line A—A in FIG. 19, and FIG. 21 shows a cross section of the process part shown in FIG. 19.

As shown in FIG. 20, the carriage 52 includes the fixing unit 63 arranged on the home position side, and the three process parts $62_1$ through $62_3$ are sequentially arranged in the carriage moving direction. The fixing unit 63 has the same construction as that shown in FIG. 7. In this case, the developing units 74 of the process parts $62_1$ through $62_3$ are filled with toners having different colors. In other words, the yellow toner $75_Y$ is provided in the process part $62_1$, the magenta toner $75_M$ is provided in the process part $62_2$, and the cyan toner $75_C$ is provided in the process part $62_3$.

Except for the color of the toners accommodated therein, the process parts $62_1$ through $62_3$ have the same construction. As shown in FIG. 21, the recording drum 71 rotates about the rotary shaft 71*a* in a direction perpendicular to the sheet transport direction. The charger 72, the exposing unit 73, the developing unit 74 (developing roller 76) and the cleaner 77 are arranged around the recording drum 71.

Figure 22:
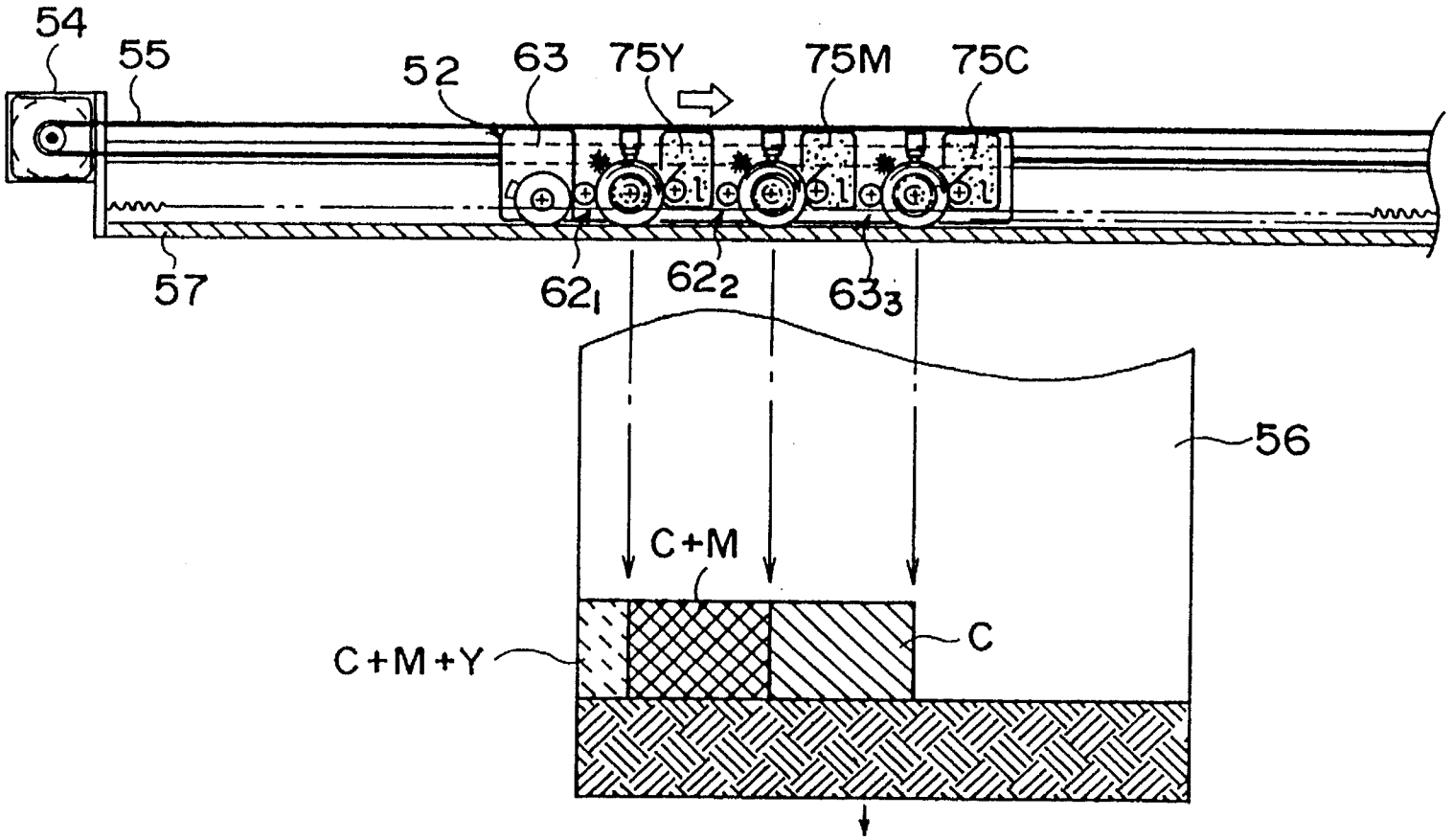
FIG. 22 is a diagram for explaining the operation of the fifth embodiment.

Next, a description will be given of the operation of the fifth embodiment, by referring to FIG. 22. In FIG. 22, the cyan toner image is formed on the recording sheet 56 by the process part $62_3$ which is arranged at the leading part of the carriage 52 in the going path along the carriage moving direction. Then, as the carriage 52 moves, the magenta and yellow toner images are successively formed on top of the cyan toner image by the respective process parts $62_2$ and $62_1$. The overlapping cyan, magenta and yellow toner images on the recording sheet 56 are pressed and fixed by the fixing unit 63, thereby fixing a color image. The intervals of the process parts $62_1$ through $62_3$ in the carriage moving direction are set accurately in advance, and the start of the operation of each of the process parts $62_1$ through $62_3$ is controlled by the main controller 86 described above or the like. When the printing of a predetermined width (predetermined printing width) on the recording sheet 56 ends by one movement (or scan) of the carriage 52 in the carriage moving direction, the recording sheet 56 is transported by an amount corresponding to the predetermined width in the sheet transport direction by the transport rollers. Thereafter, the next printing operation is started in synchronism with the movement of the carriage 52.

Accordingly, by arranging the process parts $62_1$ through $62_3$ in the carriage moving direction, it is possible to eliminate the error in the printing position caused by positioning error of the recording sheet 56, and an improved printing quality can be realized. In addition, compared to the conventional line type color printer, it is possible to reduce the size and improve the reliability of the color printer.

Figure 23A:
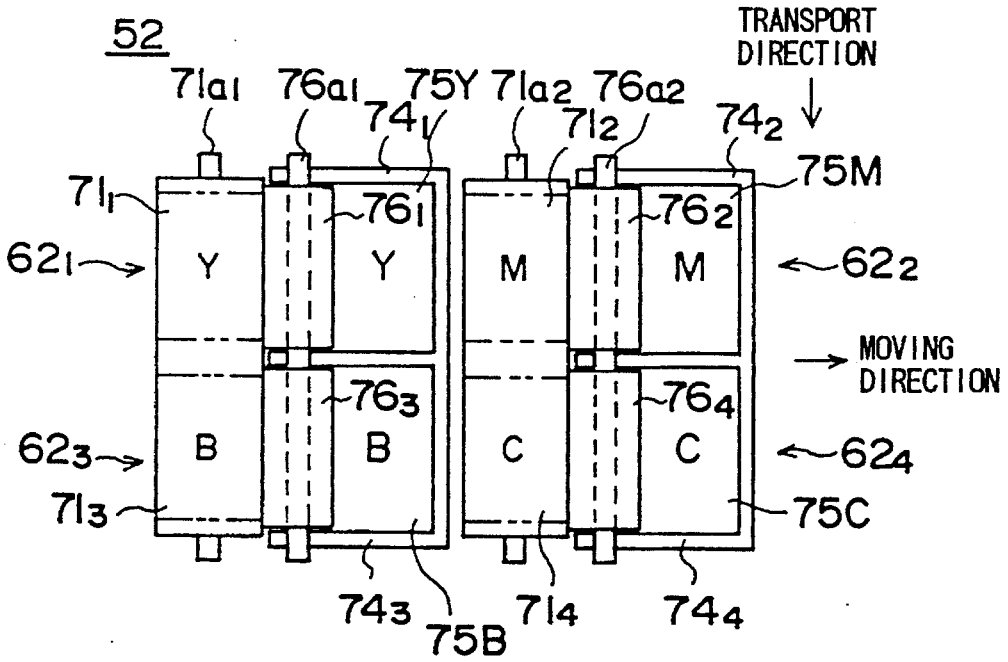
FIGS. 23A and 23B respectively are a plan view and a cross sectional view showing a sixth embodiment of the serial printer according to the present invention.
Figure 23B:
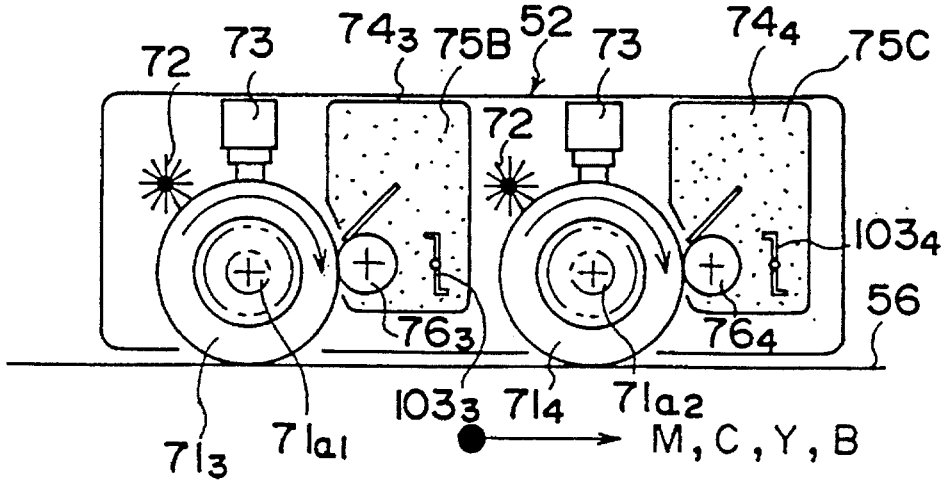

Next, a description will be given of a sixth embodiment of the serial printer according to the present invention, by referring to FIGS. 23A and 23B. FIG. 23A shows a plan view of the carriage of this sixth embodiment, and FIG. 23B is a cross sectional view of the carriage. In FIGS. 23A and 23B, those parts which are the same as those corresponding parts in FIGS. 5 through 7 and 19 are designated by the same reference numerals, and a description thereof will be omitted. In this embodiment, the construction of parts of the color printer other than the carriage is basically the same as that shown in FIG. 19.

In FIG. 23A, the carriage 52 has the process parts $62_1$ and $62_2$ arranged at a predetermined interval along the carriage moving direction, and the process parts $62_3$ and $62_4$ arranged at a predetermined interval along the carriage moving direction. The process parts $62_1$ and $62_2$ and the process parts $62_3$ and $62_4$ are arranged at a predetermined interval along the sheet transport direction. Recording drums $71_1$ through $71_4$ of developing units $74_1$ through $74_4$ are provided with respect to the corresponding process parts $62_1$ through $62_4$. The carriage 52 may have a fixing unit 63 identical to that shown in FIG. 19.

In this case, the recording drums $71_1$ and $71_3$ have a common rotary shaft $71_{a1}$, and the recording drums $71_2$ and $71_4$ have a common rotary shaft $71_{a2}$. Accordingly, it is possible to use the recording drums $71_1$ and $71_3$ and the recording drums $71_2$ and $71_4$ separately. Developing rollers $76_1$ and $76_3$ of the developing units $74_1$ and $74_3$ have a common rotary shaft $76_{a1}$, and developing rollers $76_2$ and $76_4$ of the developing units $74_2$ and $74_4$ have a common rotary shaft $76_{a2}$.

In addition, as shown in FIG. 23B, the charger 72, the exposing unit 73, and the corresponding one of the developing units $74_1$ through $74_4$ (developing rollers $76_1$ through $76_4$) are arranged around each of the recording drums $71_1$ through $71_4$.

On the other hand, the developing unit $74_1$ is filled with the yellow toner $75_Y$, and the developing unit $74_2$ is filled with the magenta toner $75_M$. The developing unit $74_3$ is filled with the black toner $75_B$, and the developing unit $74_4$ is filled with the cyan toner $75_C$. Paddles $103_1$ through $104_4$ (only $103_1$ and $103_2$ visible in FIG. 23B) are respectively provided to agitate the corresponding toners $75_Y$, $75_M$, $75_B$ and $75_C$ in the developing units $74_1$ through $74_4$.

Next, a description will be given of the operation of this sixth embodiment, by referring to FIGS. 24A, 24B, 25A, 25B, 26A and 26B.

Figures 24A, 24B:
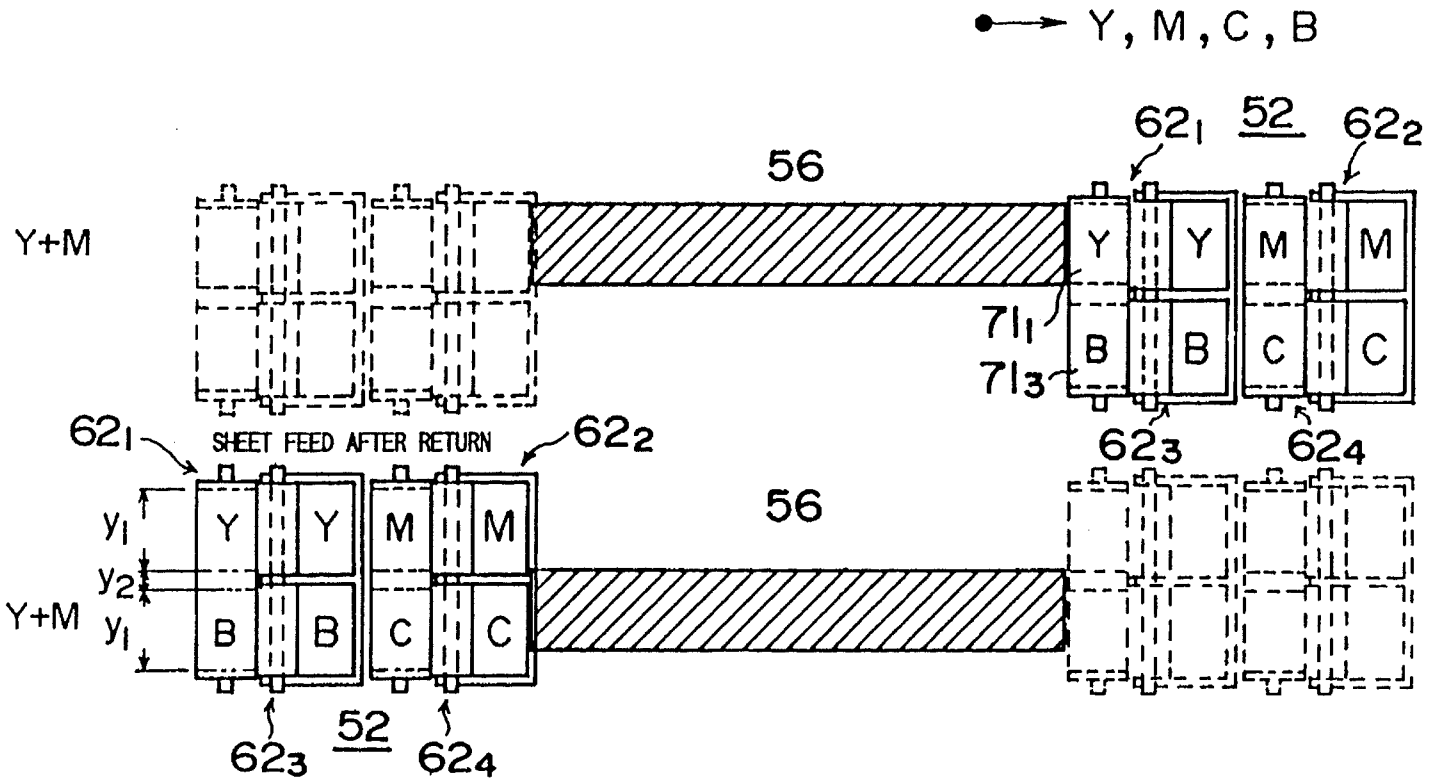
FIGS. 24A and 24B respectively are plan views for explaining the operation of the sixth embodiment.

As shown in FIG. 24A, when the carriage 52 moves from the home position towards the right in this figure, the process parts $62_1$ and $62_2$ respectively print yellow and magenta images on the recording sheet 56. In addition, as shown in FIG. 24B, the recording sheet 56 is transported in the sheet transport direction by an amount corresponding to the effective area of the printing width of the recording drums $71_1$ and $71_2$ after the carriage 52 returns to the home position or while the carriage 52 returns to the home position on the left in this figure.

Figures 25A, 25B:
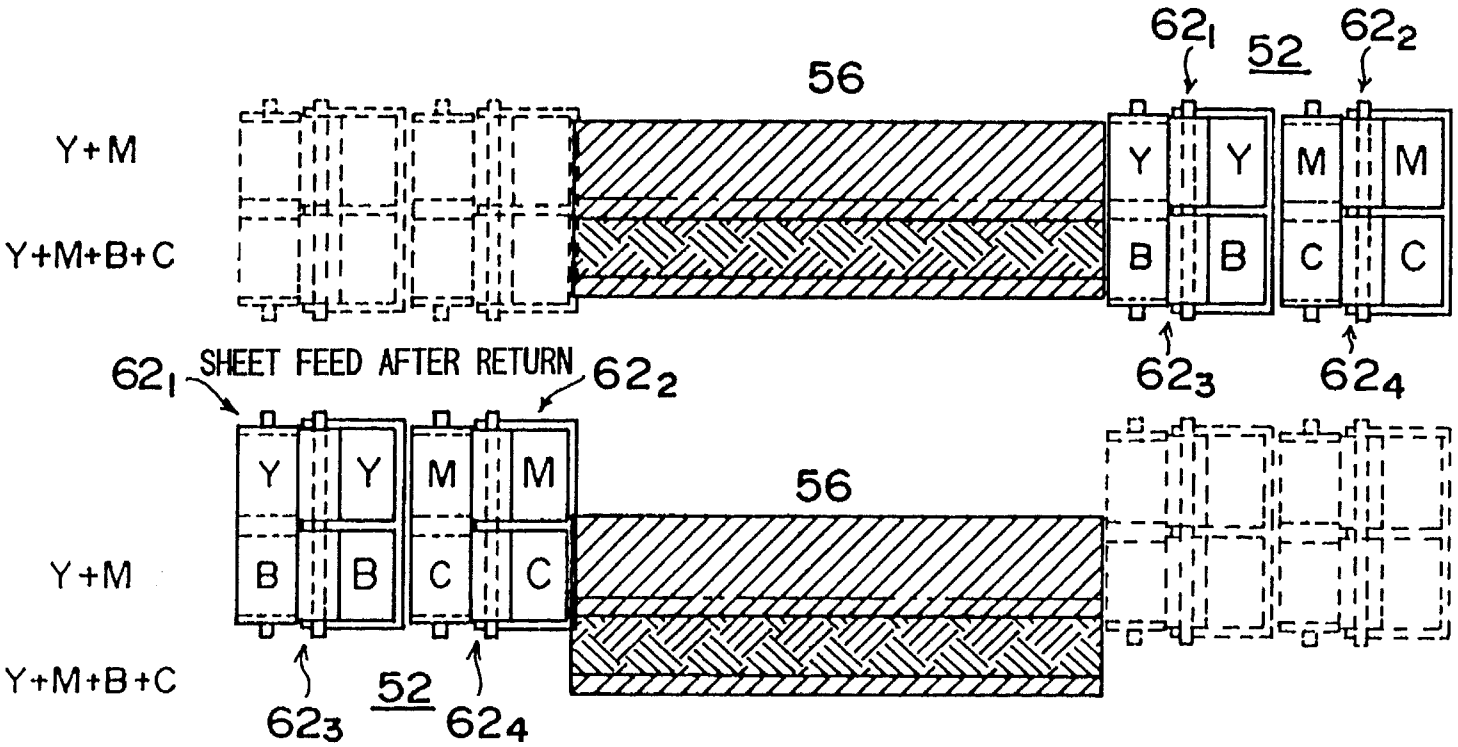
FIGS. 25A and 25B respectively are plan views for explaining the operation of the sixth embodiment.

Then, as shown in FIG. 25A, when the carriage 52 moves from the home position towards the right in this figure, the process parts $62_1$ and $62_2$ respectively print yellow and magenta images on the recording sheet 56. In addition, as shown in FIG. 25B, the recording sheet 56 is transported in the sheet transport direction by an amount corresponding to the effective area of the printing width of the recording drums $71_1$ and $71_2$ after the carriage 52 returns to the home position or while the carriage 52 returns to the home position on the left in this figure.

Figures 26A, 26B:
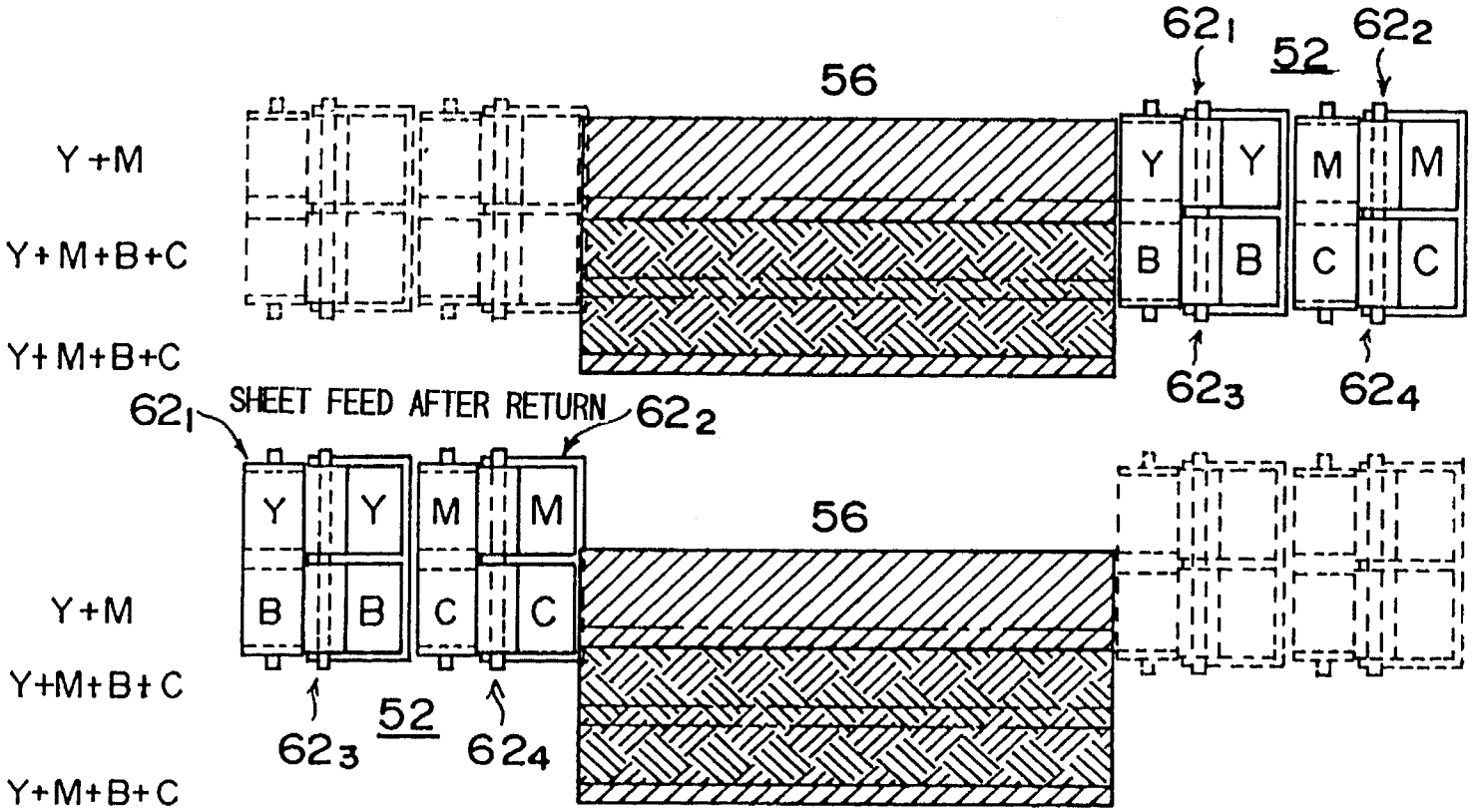
FIGS. 26A and 26B respectively are plan views for explaining the operation of the sixth embodiment.

Furthermore, when the carriage 52 moves from the home position towards the right in FIG. 25A, the process parts $62_3$ and $62_4$ respectively print cyan and black images on top of the yellow and magenta images already printed on the recording sheet 56 as shown in FIG. 26A. In addition, as shown in FIG. 26B, the recording sheet 56 is transported in the sheet transport direction by an amount corresponding to the effective area of the printing width of the recording drums $71_3$ and $71_4$ after the carriage 52 returns to the home position or while the carriage 52 returns to the home position on the left in this figure.

In other words, as may be seen from FIGS. 25A and 26A, the process parts $62_1$ and $62_2$ print yellow and magenta images on one portion of the recording sheet 56 while the process parts $62_3$ and $62_4$ print cyan and black images over the yellow and magenta images already printed on another portion of the recording sheet 56 as the carriage 52 moves from the home position towards the right in FIGS. 25A and 26A.

In FIGS. 24A through 26B, the portion of the recording sheet 56 printed with the yellow and magenta images is indicated by "Y+M", and the portion of the recording sheet 56 printed with the yellow, magenta, black and cyan images is indicated by "Y+M+B+C".

As may be seen from FIG. 24B, if the yellow effective area of the recording drum $71_1$, the magenta effective area of the recording drum $71_2$, the black effective area of the recording drum $71_3$ and the cyan effective area of the recording drum $71_4$ respectively denoted by $Y_1$, and the portion where no toner image is formed is denoted by $Y_2$, the area printed with the yellow, magenta, black and cyan images (Y+M+B+C) can be described by $Y_1-Y_2$, and the area printed with the yellow and magenta images (Y+M) can be described by $Y_1+2\times Y_2$. Accordingly, a portion where only the yellow and magenta images (Y+M) are printed exists at both the leading and trailing (begging and end) portions of the recording sheet 56 along the sheet transport direction. However, by controlling the exposure of the exposing units 53 for the yellow and magenta printing, it is possible to eliminate the unwanted yellow and magenta images (Y+M) at the leading and trailing portions of the recording sheet 56.

According to this sixth embodiment, it is possible to realize a color printer which is more compact and inexpensive compared to the conventional line type color printer. In addition, it is possible to realize a high-speed printing compared to the conventional line type color printer. Moreover, it is possible to improve the printing quality because it is unnecessary to provide a relief mechanism for the developing roller with respect to the recording drum as was necessary in the case of the conventional line type color printer.

Figure 27A:
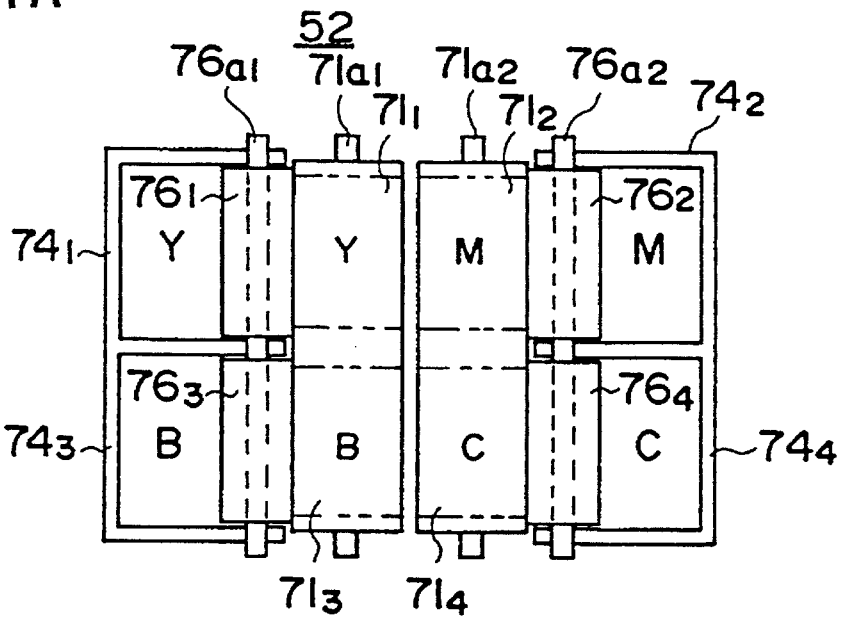
FIGS. 27A and 27B respectively are a plan view and a cross sectional view showing a seventh embodiment of the serial printer according to the present invention.
Figure 27B:
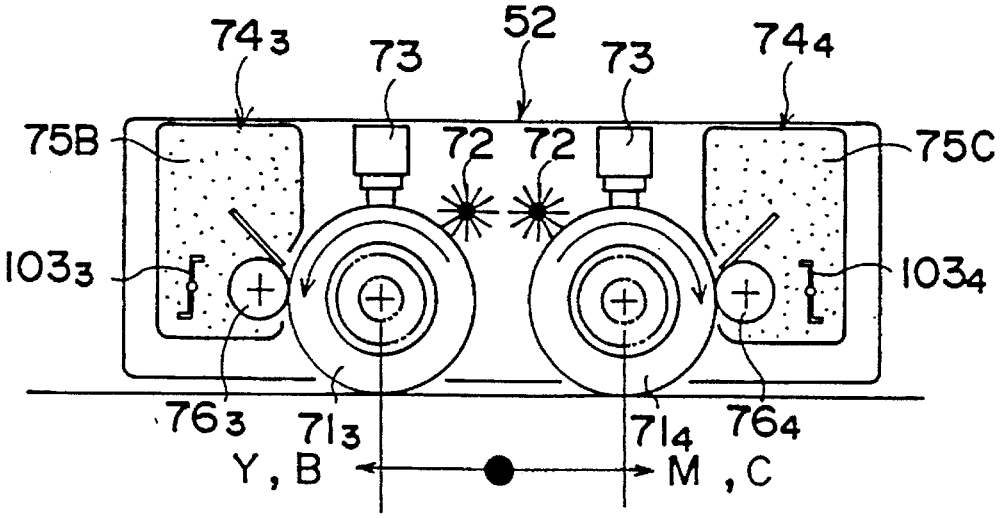

Next, a description will be given of a seventh embodiment of the serial printer according to the present invention, by referring to FIGS. 27A and 27B. FIG. 27A shows a plan view of the carriage of this seventh embodiment, and FIG. 27B is a cross sectional view of the carriage. In FIGS. 27A and 27B, those parts which are the same as those corresponding parts in FIGS. 23A and 23B are designated by the same reference numerals, and a description thereof will be omitted. In this embodiment, the construction of parts of the color printer other than the carriage is basically the same as that shown in FIG. 19.

The carriage 52 shown in FIGS. 27A and 27B has the recording drums $\mathbf{71}_1$ through $\mathbf{71}_4$ arranged on the inner sides of the developing units $\mathbf{74}_1$ through $\mathbf{74}_4$ which are respectively filled with the toners $\mathbf{75}_Y$, $\mathbf{75}_M$, $\mathbf{75}_B$ and $\mathbf{75}_C$. Otherwise, the construction of this seventh embodiment is basically the same as that of the sixth embodiment described above. In this case, the fixing units have a fixing roller having a length at least amounting to the printing effective area $(2Y_1+Y_2)$, and the fixing units are provided on the outer sides of the process parts $\mathbf{62}_1$ through $\mathbf{62}_4$ of the carriage 52 in the carriage moving direction.

Next, a description will be given of the operation of this seventh embodiment, by referring to FIGS. 28A, 28B, 29A, 29B, 30A and 30B.

Figures 28A, 28B:
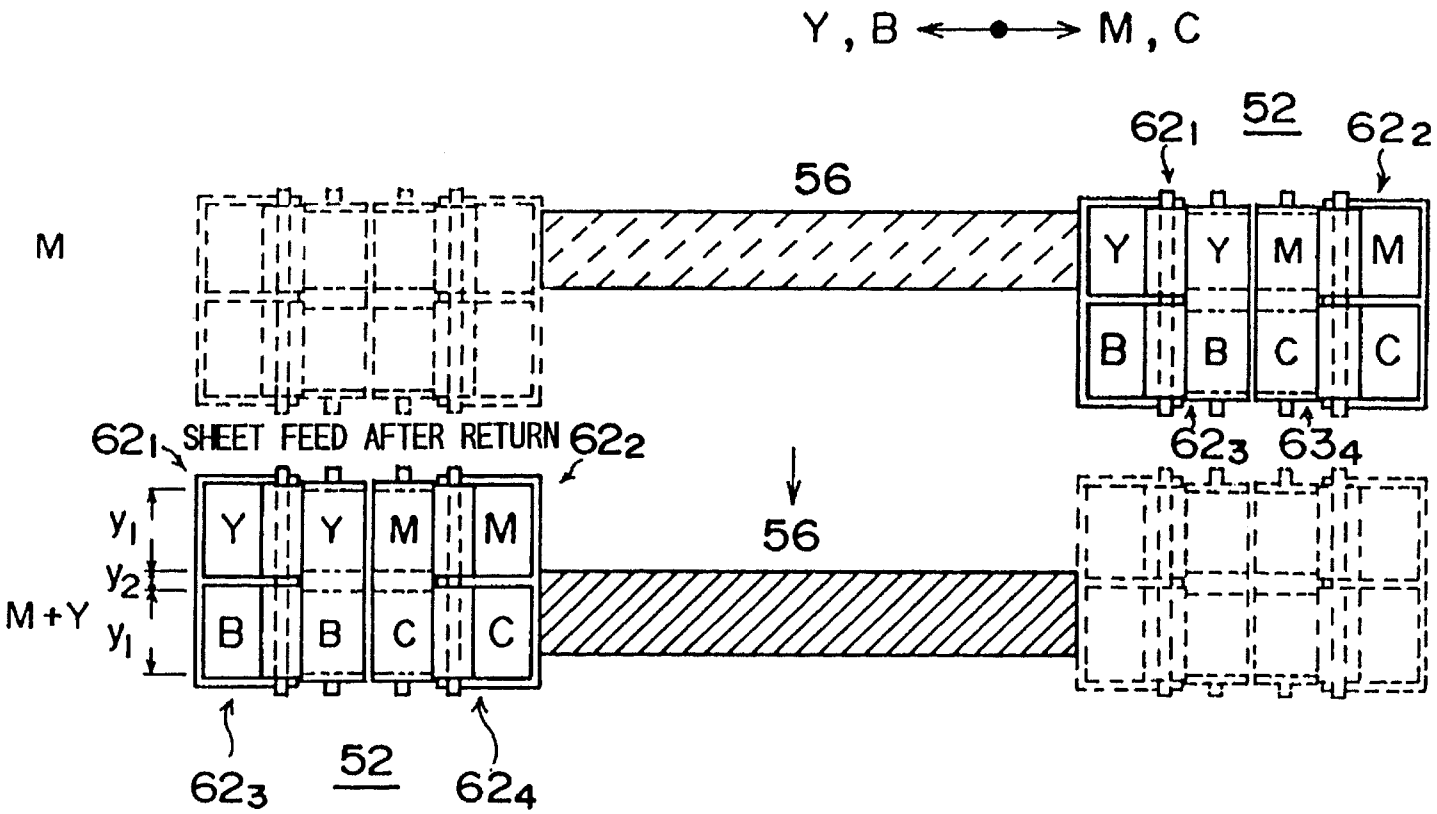
FIGS. 28A and 28B respectively are plan views for explaining the operation of the seventh embodiment.

As shown in FIG. 28A, when the carriage 52 moves from the home position towards the right in this figure, the process part $\mathbf{62}_2$ prints a magenta image on the recording sheet 58. In addition, as shown in FIG. 28B, the process part $\mathbf{62}_1$ prints a yellow image over the magenta image as the carriage 52 returns towards the home position, thereby forming overlapping magenta and yellow images (M+Y). The recording sheet 56 is transported in the sheet transport direction by an amount $(Y_1+Y_2)$ corresponding to the effective area of the printing width of the recording drums after the carriage 52 returns to the home position.

Figures 29A, 29B:
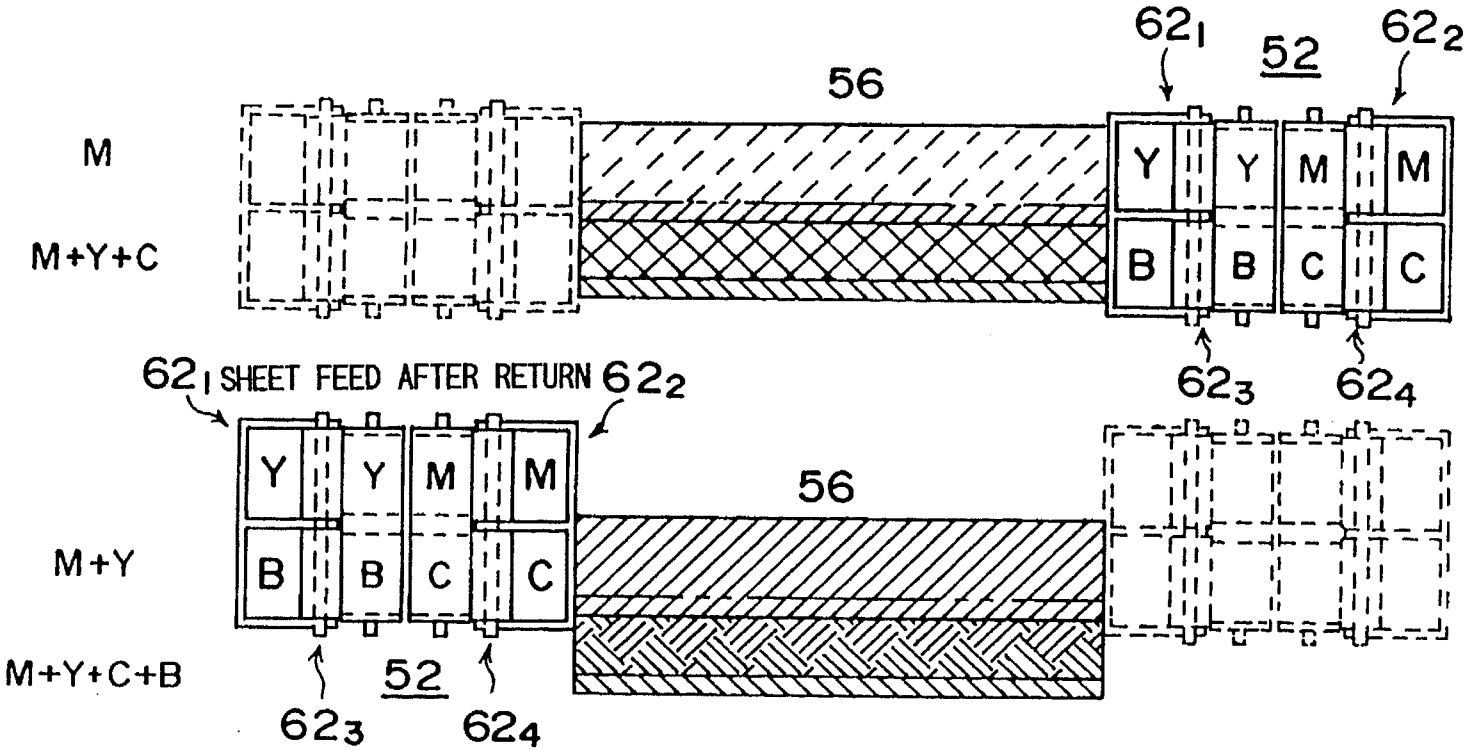
FIGS. 29A and 29B respectively are plan views for explaining the operation of the seventh embodiment.

Then, as shown in FIG. 29A, when the carriage 52 moves from the home position towards the right in this figure, the process part $\mathbf{62}_2$ prints a magenta image and the process part $\mathbf{62}_4$ prints a cyan image over the magenta and yellow images already printed on the recording sheet 56, thereby forming overlapping magenta, yellow and cyan images (M+Y+C). In addition, as shown in FIG. 29B, as the carriage 52 returns towards the home position, the process part $\mathbf{62}_1$ prints a yellow image over the magenta image already printed on the recording sheet 56 to thereby form overlapping magenta and yellow images (M+Y), and the process part $\mathbf{62}_3$ prints a black image over the magenta, yellow and cyan images already printed on the recording sheet 56 to thereby form overlapping magenta, yellow, cyan and black images (M+Y+C+B). The recording sheet 56 is transported in the sheet transport direction by an amount $(Y_1+Y_2)$ corresponding to the effective area of the printing width of the recording drums after the carriage 52 returns to the home position.

Figures 30A, 30B:
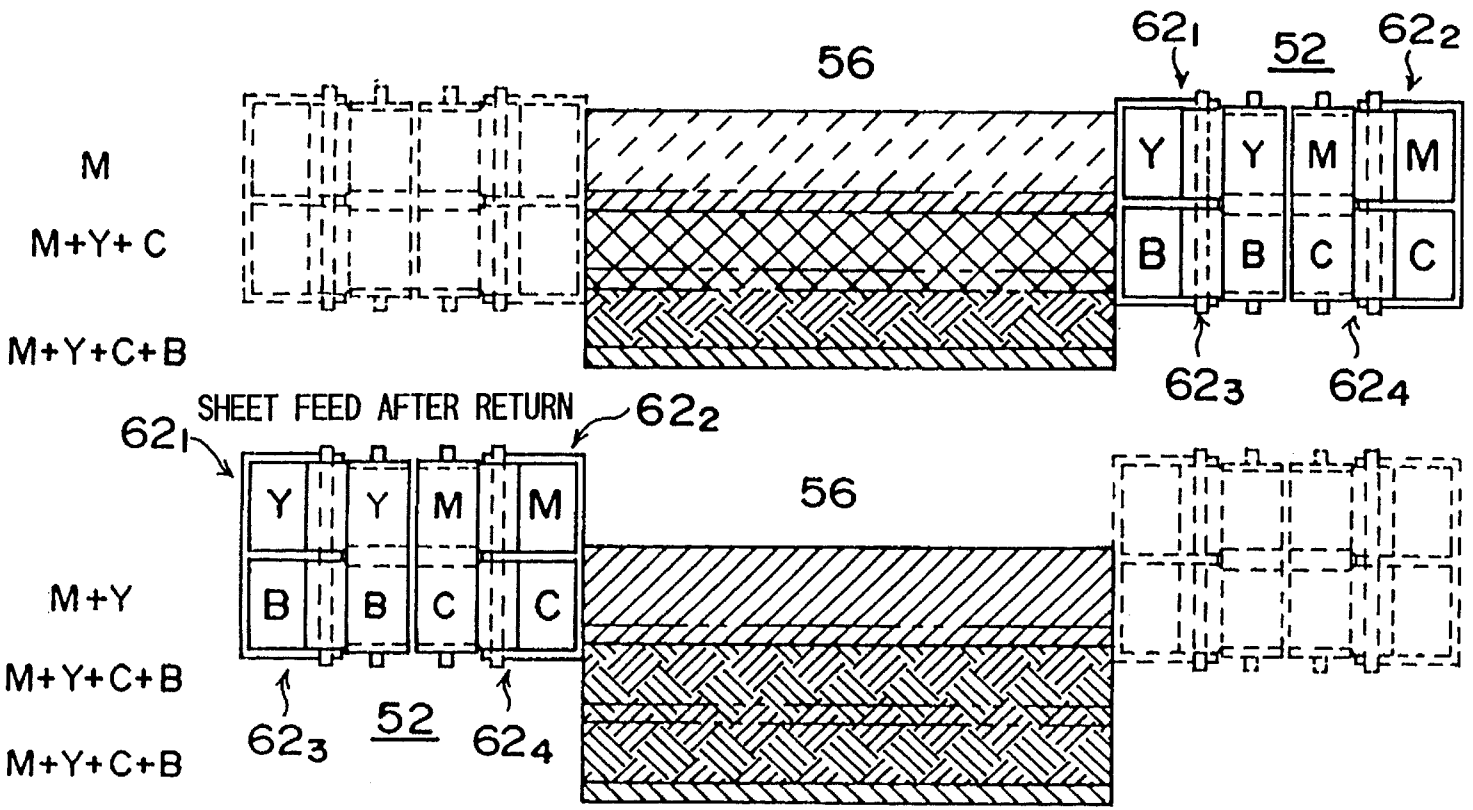
FIGS. 30A and 30B respectively are plan views for explaining the operation of the seventh embodiment.

Next, as shown in FIG. 30A, when the carriage 52 moves from the home position towards the right in this figure, the process part $\mathbf{62}_2$ prints a magenta image and the process part $\mathbf{62}_4$ prints a cyan image over the magenta and yellow images already printed on the recording sheet 56, thereby forming overlapping magenta, yellow and cyan images (M+Y+C). In addition, as shown in FIG. 30B, as the carriage 52 returns towards the home position, the process part $\mathbf{62}_1$ prints a yellow image over the magenta image already printed on the recording sheet 56 to thereby form overlapping magenta and yellow images (M+Y), and the process part $\mathbf{62}_3$ prints a black image over the magenta, yellow and cyan images already printed on the recording sheet 56 to thereby form overlapping magenta, yellow, cyan and black images (M+Y+C+B). The recording sheet 56 is transported in the sheet transport direction by an amount $(Y_1+Y_2)$ corresponding to the effective area of the printing width of the recording drums after the carriage 52 returns to the home position.

The above described printing operations are repeated in a similar manner.

Therefore, in this seventh embodiment, the printing and fixing of the images are carried out as the carriage 52 travels in the going and returning paths along the carriage moving direction. As a result, in addition to the effects obtainable in the sixth embodiment described above, it is possible to reduce the distance between the recording drums $\mathbf{71}_1$ and $\mathbf{71}_3$ and the distance between the recording drums $\mathbf{71}_2$ and $\mathbf{71}_4$ along the sheet transport direction, and the moving distance of the carriage 52 can be reduced so that the length of the color printer in the carriage moving direction can be reduced. In addition, the size of the fixing unit can be reduced compared to the line type fixing unit, because the fixing operation is carried out as the carriage 52 travels in the going and returning paths along the carriage moving direction. Accordingly, the overall size of the color printer can be reduced in this seventh embodiment.

Further, the present invention is not limited to these embodiments, but various variations and modifications may be made without departing from the scope of the present invention.

What is claimed is:

1. A serial printer, comprising:

a plurality of printing assemblies each including:

transport means for transporting a recording sheet in a sheet transport direction, process means, including an image bearing member with a rotary shaft which extends in a direction parallel to the sheet transport direction, for forming a latent image on the image bearing member by charging the image bearing member and developing the latent image into a developed image, fixing means, including a first fixing member, for fixing the developed image on the image bearing member onto the recording sheet by the first fixing member, at least one printing carriage movable in a carriage moving direction perpendicular to the sheet transport direction and supporting said process means and said fixing means, transfer means for transferring the developed image formed on the image bearing member onto the recording sheet that is interposed between said transfer means and said printing carriage, said image bearing member rotating in synchronism with a moving speed of said printing carriage, and first moving means for moving said printing carriage in the carriage moving direction, said printing assemblies being arranged at predetermined intervals in the sheet transport direction; and control means for controlling said transport means so that the recording sheet is transported by predetermined amounts in the sheet transport direction; and a fixing assembly arranged at a predetermined interval from one of said printing assemblies provided at a last stage along the sheet transport direction, wherein said fixing assembly includes:

a fixing carriage having a second fixing member, and second moving means for moving the fixing carriage in a direction perpendicular to the sheet transport direction.

2. The serial printer as claimed in claim 1, which further comprises:

means for setting said second fixing member of said fixing assembly to a temperature higher than that of the first fixing member of said fixing means in each of said printing assemblies.

3. The serial printer as claimed in claim 1, wherein said second moving means moves said fixing carriage of said fixing assembly to travel only one of going and returning paths along the carriage moving direction so that said second fixing member carries out a fixing operation during a time in which said printing carriage of said printing assembly travels in both going and returning paths along the carriage moving direction.

4. The serial printer as claimed in claim 1, wherein at least three printing assemblies are arranged in parallel at the predetermined intervals in the sheet transport direction, and said process means of said three printing assemblies respectively include process parts provided with developing agents having mutually different colors.

5. A serial printer, comprising:

a plurality of printing assemblies each including:

transport means for transporting a recording sheet in a sheet transport direction, process means, including an image bearing member with a rotary shaft which extends in a direction parallel to the sheet transport direction, for forming a latent image on the image bearing member by charging the image bearing member and developing the latent image into a developed image, fixing means, including a first fixing member, for fixing the developed image on the image bearing member onto the recording sheet by the first fixing member, at least one printing carriage movable in a carriage moving direction perpendicular to the sheet transport direction and supporting said process means and said fixing means, transfer means for transferring the developed image formed on the image bearing member onto the recording sheet that is interposed between said transfer means and said printing carriage, said image bearing member rotating in synchronism with a moving speed of said printing carriage, and first moving means for moving said printing carriage in the carriage moving direction, said printing assemblies being arranged at predetermined intervals in the sheet transport direction; and control means for controlling said transport means so that the recording sheet is transported by predetermined amounts in the sheet transport direction, wherein:

said image bearing member of each printing assembly has said printing width a, said printing assemblies are arranged in parallel at said distance, which is defined as b, between the printing widths, which are defined as a, of the image bearing members of adjacent printing assemblies, where b=na and n is an integer, and wherein said control means controls said transport means to transport the recording sheet in the sheet transport direction by a distance a every time said printing carriage travels in both the going and returning paths along the carriage moving direction, and controls said transport means to transport the recording sheet in the sheet transport direction by a distance 2na every time said printing carriage travels 2n times in both the going and returning paths along the carriage moving direction.

6. A serial printer, comprising:

a plurality of printing assemblies each including:

transport means for transporting a recording sheet in a sheet transport direction, process means, including an image bearing member with a rotary shaft which extends in a direction parallel to the sheet transport direction, for forming a latent image on the image bearing member by charging the image bearing member and developing the latent image into a developed image, fixing means, including a first fixing member, for fixing the developed image on the image bearing member onto the recording sheet by the first fixing member, at least one printing carriage movable in a carriage moving direction perpendicular to the sheet transport direction and supporting said process means and said fixing means, transfer means for transferring the developed image formed on the image bearing member onto the recording sheet that is interposed between said transfer means and said printing carriage, said image bearing member rotating in synchronism with a moving speed of said printing carriage, and first moving means for moving said printing carriage in the carriage moving direction, said printing assemblies being arranged at predetermined intervals in the sheet transport direction; and control means for controlling said transport means so that the recording sheet is transported by predetermined amounts in the sheet transport direction, wherein each of said printing assemblies comprises two printing carriages having identical constructions including said process means and said fixing means, and each of said printing assemblies carries out a printing operation with respect to the recording sheet as the printing assemblies travel in at least one of going and returning paths along the carriage moving direction.

7. The serial printer as claimed in claim 6, wherein said process means of said printing carriages in each of said printing assemblies are provided with developing agents having colors selected from a group consisting of a single color and mutually different colors.

8. The serial printer as claimed in claim 6, which further comprises:

recession means, provided with respect to each of said process means, for separating the image bearing member from the recording sheet.

9. A serial printer, comprising:

transport means for transporting a recording sheet in a sheet transport direction;

a plurality of process means;

a printing carriage movable in a carriage moving direction perpendicular to the sheet transport direction and supporting said plurality of process means; and moving means for moving said printing carriage in the carriage moving direction, each of said plurality of process means including an image bearing member with a rotary shaft which extends in a direction parallel to the sheet transport direction and a developing means, for forming a latent image on the image bearing member by charging the image bearing member and developing the latent image into a developed image by the developing means, said developing means of said plurality of process means being provided with developing agents of mutually different colors in the sheet transport direction, wherein said plurality of process means are arranged in the carriage moving direction on said printing carriage.

10. The serial printer as claimed in claim 9, wherein said plurality of process means have said developing means arranged on a downstream side of said image bearing members in the carriage moving direction in which process means carry out a printing operation.

11. The serial printer as claimed in claim 9, wherein said plurality of process means have said image bearing members arranged on inner sides of said developing means.

* * * * *